United States Patent [19]

Furukubo

[11] 4,370,950

[45] Feb. 1, 1983

[54] ENGINE COOLING SYSTEM AND CONTROL VALVE ASSEMBLY PROVIDING MIXED OR UNMIXED HEAD AND BLOCK COOLING

[75] Inventor: Tatsumi Furukubo, Susono, Japan

[73] Assignee: Toyota Jidosha Kabushiki Kaisha, Toyota, Japan

[21] Appl. No.: 325,196

[22] Filed: Nov. 27, 1981

[30] Foreign Application Priority Data

Dec. 2, 1980 [JP] Japan ..... 55-169933

[51] Int. Cl.[3] ..... F01P 3/02; F01P 7/16

[52] U.S. Cl. ..... 123/41.08; 123/41.1; 123/41.29; 123/41.44; 123/41.82 R; 236/34.5

[58] Field of Search ..... 123/41.01, 41.02, 41.08, 123/41.09, 41.1, 41.29, 41.44, 41.82 R, 41.82 A; 236/34.5

[56] References Cited

U.S. PATENT DOCUMENTS

| | | | |
|---|---|---|---|
| 1,985,240 | 12/1934 | Brubaker | 123/41.44 |
| 3,444,845 | 5/1969 | Scheiterlein | 123/41.82 |
| 3,752,132 | 8/1973 | Bentz et al. | 123/41.1 |
| 3,757,747 | 9/1973 | Hartmann | 123/41.29 |
| 3,877,443 | 4/1975 | Henning et al. | 123/41.1 |
| 4,109,617 | 8/1978 | Ernest | 123/41.82 R |
| 4,212,270 | 7/1980 | Nakanishi et al. | 123/41.44 |
| 4,249,491 | 2/1981 | Stein | 123/196 AB |

*Primary Examiner*—William A. Cuchlinski, Jr.

*Attorney, Agent, or Firm*—Stevens, Davis, Miller & Mosher

[57] ABSTRACT

A cooling system for an engine which has head and block cooling jackets and a radiator, including head and block coolant pumps, a block recirculation conduit from the block outlet to the block inlet, a main recirculation conduit from the head outlet to the head inlet via the radiator, a first junction providing sometimes communication between upstream parts of the block recirculation conduit and the main recirculation conduit, a second junction providing communication between a downstream part of the block recirculation conduit and a part of the main recirculation conduit at the downstream side of the radiator, and a mechanical non-electrical control valve assembly which is incorporated in the first junction and controls the allocation of head flow and block flow between the block recirculation conduit and the main recirculation conduit, according to the temperature of the coolant leaving the block jacket. The control valve assembly, when this temperature is below a first value, directs both head and block flow through the block recirculation conduit, bypassing the radiator; when this temperature is between the first value and a second value higher than the first value, directs the head flow through the main recirculation conduit, but directs the block flow through the block recirculation conduit; and when this temperature is above the second valve, directs both head and block flow through the main recirculation conduit.

30 Claims, 6 Drawing Figures

ENGINE COOLING SYSTEM AND CONTROL VALVE ASSEMBLY PROVIDING MIXED OR UNMIXED HEAD AND BLOCK COOLING

BACKGROUND OF THE INVENTION

The present invention relates to an internal combustion engine cooling system and a valve therefor, and, more particularly, relates to an internal combustion engine cooling system and a valve therefor which provide either combined cooling for a cylinder head and a cylinder block of the engine, or either partly or totally separated cooling for the cylinder head and the cylinder block, according to operational conditions.

The concept of the present invention is based upon a prior art engine cooling system and method developed by a colleague of the present inventor, for which previous concept Japanese Patent Application No. 68036/80 was filed previously to the filing on Dec. 2, 1980 of the parent Japanese patent application No. 169933/80 of the present application of which priority is being claimed in the present application, and for which prior art concept also it is known to the present inventor that U.S. patent application Ser. No. 264,866 has been filed with the filing date of May 18, 1981 previously to the filing of the present application claiming the priority of said previous Japanese application, said previously applied Japanese and U.S. patent applications relating to said prior art concept being invented by a different inventor than but being assigned to the same assignee as the present application; and the present inventor hereby desires to acknowledge his debt to this previous proposal, and to incorporate the subject matter of that previous U.S. patent application by reference into the present application, by way of background prior art.

There are various considerations which arise with regard to the cooling of internal combustion engines which are cooled by the circulation of cooling fluid in passages or cooling jackets formed in the cylinder head and in the cylinder block thereof. Some of these considerations relate to the cooling of the cylinder head, and others to the cooling of the cylinder block. Nowadays the prior art type old or conventional ways of cooling an internal combustion engine, in which the cooling fluid for the cylinder head was always completely mixed with that for the cylinder block, thus ensuring that the cylinder head and the cylinder block were always at substantially the same temperature, have become inadequate.

One of these considerations is that it is important to maximize the thermal efficiency of an internal combustion engine, and in order to do this it is effective to increase the compression ratio of the engine. However, increase of the compression ratio of the engine is limited by the occurrence of so called knocking or pinking, i.e. of detonation caused by compression ignition, not caused by any spark from a spark plug, of the air-fuel mixture within the combustion chambers of the engine. The occurrence of knocking is generally reduced by keeping the cylinder head as cool as possible, and accordingly when an internal combustion engine is being operated, especially in operational conditions in which the occurrence of knocking is a high possibility, such as high rotational speed high engine load operational conditions, it is very important to cool the cylinder head down to as low a temperature as possible, consistent with other operational considerations.

On the other hand, it is not very advantageous to cool down the cylinder block of the engine to a very low temperature, because in that case the temperature of the lubricating oil contained within the cylinder block, which is of course strongly influenced by the temperature of the cylinder block, becomes rather low, thus increasing the viscosity of this lubricating oil and causing unacceptably high mechanical energy losses in the engine. Further, because the viscosity of the lubricating oil within the cylinder block when this oil is cold, i.e. when it is not at proper operating temperature, is higher than when said lubricating oil is at operating temperature, therefore of course while this lubricating oil is cold this causes substantially increased use of fuel by the internal combustion engine, which is very wasteful. Further, if the temperature of the walls of the cylinders of the engine, i.e. the temperature of the bores thereof, becomes low, then the amount of noxious components in the exhaust gases emitted by the engine rises, which can cause a serious problem in view of the standards for control of pollution by automobiles, which are becoming more and more severe nowadays.

Another problem that occurs if the temperature of the cylinder block gets low is that wear on the various moving parts of the internal combustion engine, especially bore wear, rises dramatically. In fact, a large proportion of the wear on the bores of an internal combustion engine occurs when the engine is in the non fully warmed up condition, both because the lubricating qualities of the lubricating oil in the engine are not good at low temperatures, and also because the state of mechanical fit to which the parts of the engine are "worn in" or "run in" is appropriate to their physical dimensions when at proper engine operating temperature, and accordingly in the cold or the semi cold condition these parts do not mate together very well.

These problems that arise when the cylinder block of an internal combustion engine becomes too cold during actual running operation of the engine of course also apply with equal force during the warming up process of the internal combustion engine, after it has been started up from the cold condition and before it has attained normal operating temperature. Especially, the problem of excessive wear on the moving parts of the internal combustion engine, and the problem of excessive emission of noxious components in the exhaust gases of the internal combustion engine, are particularly serious during warming up operation. In fact, in view of this matter, it has in the past been an important design goal for internal combustion engines for the moving parts thereof to be warmed up as soon as practicable, or at any rate to be brought to an intermediate temperature higher than a very cold non operating temperature as soon as practicable.

According to these considerations, it is important to warm up the cylinder block of an internal combustion engine as quickly as possible, when the engine is started from the cold condition, and to keep the cylinder block at quite a high operating temperature thereafter. A difficulty arises in this regard, because during the operation of an internal combustion engine most of the heat which is being generated in the combustion chambers thereof by combustion of air-fuel mixture therein is in fact communicated not to the cylinder block of the engine, but to the cylinder head thereof. Therefore transfer of heat from the cylinder head wherein said heat is generated to the cylinder block is very important, especially during the warming up process of the engine. Of course, such heat transfer can take place by the process of heat conduction, since the cylinder head is clamped to the cylinder block, typically however with the interposition between of a head gasket which may have a rather low heat conductivity. However, it is desirable to convey heat from the cylinder head to the cylinder block, during engine warmup, more quickly than can be accomplished by this conduction process, and the conventional above described mixing of the cooling fluid circulating within the cylinder head with the cooling fluid circulating within the cylinder block, during engine warmup, is effective for achieving this.

Therefore in the above mentioned prior patent application, it was proposed to provide, for an internal combustion engine comprising: (a) a cylinder head formed with a head cooling jacket for cooling said cylinder head, said head cooling jacket being formed with a cylinder head inlet and a cylinder head outlet; (b) a cylinder block formed with a block cooling jacket for cooling said cylinder block, said block cooling jacket being formed with a cylinder block inlet and a cylinder block outlet; and (c) a radiator formed with an inlet and an outlet: a cooling system, comprising: (d) a first pump for impelling cooling fluid through said head cooling jacket from said cylinder head inlet towards said cylinder head outlet; (e) a second pump for impelling cooling fluid through said block cooling jacket from said cylinder block inlet towards said cylinder block outlet; (f) a block output fluid temperature sensor for sensing the temperature of the cooling fluid which passes out through said cylinder block outlet of said block cooling jacket, and for generating a sensed block output temperature signal representative of said temperature; (g) a block recirculation conduit system leading from said cylinder block outlet of said block cooling jacket so as to supply flow of cooling fluid, from a downstream part of said block recirculation conduit system, to said cylinder block inlet of said block cooling jacket; (h) a main recirculation conduit system, an upstream part of which is communicated to said cylinder head outlet of said head cooling jacket, and a downstream part of which is communicated to said inlet of said radiator; (i) a radiator output conduit system, leading from said outlet of said radiator both to said cylinder head inlet of said head cooling jacket and also to said cylinder block inlet of said block cooling jacket, said downstream part of said block recirculation conduit system being thereby communicated also to said cylinder head inlet of said head cooling jacket; (j) a first control valve for controlling flow of cooling fluid through said radiator according to a radiator flow regulation signal; (k) a flow mixing conduit which communicates a part of said main recirculation conduit system with a part of said block recirculation conduit system; (l) a second control valve for controlling flow of cooling fluid through said flow mixing conduit according to a block flow regulation signal; and (m) a controller, which receives said sensed block output temperature signal from said block output fluid temperature sensor, and which produces, based thereon, said radiator flow regulation signal which is sent to said first control valve, and also said block flow regulation signal which is sent to said second control valve.

According to such a prior art structure, the controller can vary the amount of cooling operation provided for the internal combustion engine, by varying the opening amount of the first control valve, thus varying the amount of cooling fluid passing through the radiator, and can also vary the amount of mixing between the cooling circuit for the cylinder head and the cooling circuit for the cylinder block, by varying the opening amount of the second control valve, thus varying the amount of cooling fluid passing through the flow mixing conduit.

Further, according to a particular aspect of the above mentioned prior art, a method for operating the cooling system described above when said cooling system is filled with cooling fluid was proposed, comprising the processes, simultaneously performed, of: (o) operating said first pump and said second pump; and (p) depending upon said sensed block output temperature signal from said block output fluid temperature sensor, performing either one or the other but not both of the following two processes (q) and (r): (q) if said sensed block output temperature signal from said block output fluid temperature sensor indicates a cooling fluid temperature at said cylinder block outlet of said block cooling jacket of less than a certain first predetermined temperature value, then simultaneously: (q1) controlling said first control valve, by said radiator flow regulation signal from said controller, so as substantially to interrupt flow of cooling fluid through said radiator; and (q2) controlling said second control valve, by said block flow regulation signal, so as to allow a flow of cooling fluid through said flow mixing conduit; (r) if said sensed block output temperature signal from said block output fluid temperature sensor indicates a cooling fluid temperature at said cylinder block outlet of said block cooling jacket of greater than said first predetermined temperature value, then simultaneously: (r1) controlling said first control valve, by said radiator flow regulation signal from said controller, so as to allow cooling fluid to flow through said radiator; and (r2) controlling said second control valve, by said block flow regulation signal, so as to allow a controlled flow of cooling fluid through said flow mixing conduit.

According to such a method, during the warming up process of the internal combustion engine, before the cooling fluid which passes out through the cylinder block outlet of the block cooling jacket has attained the first predetermined temperature, the cooling systems for the cylinder head and for the cylinder block are substantially communicated, and no substantial cooling is provided for either by the radiator, so that the heat which is supplied to the cooling fluid within the head cooling jacket is communicated to the cooling fluid within the block cooling jacket, and both the cylinder head and the cylinder block are quickly warmed up together; but, after the cooling fluid which passes out through the cylinder block outlet of the block cooling jacket has attained the first predetermined temperature, then according to process (r1) substantial cooling is provided for the cooling fluid in the head cooling jacket, while according to process (r2) the amount of cooling provided for the cooling fluid in the block cooling jacket is regulated. Thus, after the internal combustion engine has been warmed up, the cylinder block may be kept substantially warmer than the cylinder head.

Further, according to a particular aspect of the the above mentioned prior art, a method of the sort described above was proposed, said cooling system further comprising an engine lubricating oil temperature sensor for detecting the temperature of lubricating oil contained within said cylinder block, and for producing a lubricating oil temperature signal representative thereof, said lubricating oil temperature signal being supplied to said controller; wherein in process (r) the opening amount of said second valve is so controlled, by said block flow regulation signal, as to allow such an amount of cooling fluid to flow through said flow mixing conduit as to keep the sensed block output temperature signal produced by said block output fluid temperature sensor approximately at a level indicative of a second predetermined temperature, except that if the engine lubricating oil temperature signal produced by said engine lubricating oil temperature sensor is indicative of a lubricating oil temperature of the lubricating oil contained within said cylinder block of higher than a third predetermined temperature, then such a block flow regulation signal is supplied to said second control valve as to cause said second control valve to open to the maximum amount; wherein said second predetermined temperature is substantially higher than said first predetermined temperature; wherein said third predetermined temperature is substantially higher than said second predetermined temperature; and wherein in process (r), if said temperature indicated by said sensed block output temperature signal is substantially higher than said second predetermined temperature, and is less than said third predetermined temperature, then said second valve is so controlled, by said block flow regulation signal, as to open up said second valve wider so as to decrease its flow resistance; and, if said indicated temperature is substantially lower than said second predetermined temperature, said second valve is so controlled as to make said second valve more closed so as to increase its flow resistance.

According to such a method, by a feedback control, the cooling fluid temperature at said cylinder block oulet of said block cooling jacket is controlled to be substantially equal to said second predetermined temperature, except in said emergency case when the temperature of said lubricating oil contained within said cylinder block rises to higher than said third predetermined temperature which is the danger temperature.

The above described prior art proposal was quite good, within its sphere; but the requirement for such a controller, operating according to such a type of logic, inevitably meant in practice that an electric or electronic controller needed to be provided, and thus the above mentioned control valves were required to be electrically operated valves, and the temperature sensors were also required to be electrical output sensors.

SUMMARY OF THE INVENTION

The present invention strives to provide the sort of double cooling system, and a valve therefor, providing alternatively either mixed or unmixed cylinder head and cylinder block cooling such as described above which is sophisticated and ingenious and has in the past been practiced by using electrical logic devices, by a mechanical structure, which has advantages in its own way over electrical devices, as is well appreciated in the relevant field of industry.

Accordingly, it is the primary object of the present invention to provide a cooling system, and a valve assembly therefor, incorporating no electrical regulation system, which improves upon the anti knock characteristic of an internal combustion engine.

It is a further object of the present invention to provide a cooling system, and a valve assembly therefor, incorporating no electrical regulation system, for an internal combustion engine which keeps the cylinder head cool, so as to reduce the possibility of the occurrence of knocking in the combustion chambers of the internal combustion engine.

It is a further object of the present invention to provide a cooling system, and a valve assembly therefor, incorporating no electrical regulation system, for an internal combustion engine which, when the internal combustion engine has reached a steady temperature operational condition, keeps the cylinder head thereof cooler than the cylinder block.

It is a further object of the present invention to provide a cooling system, and a valve assembly therefor, incorporating no electrical regulation system, for an internal combustion engine which warms up the cylinder block of the internal combustion engine as quickly as possible from the cold condition.

It is a further object of the present invention to provide a cooling system, and a valve assembly therefor, incorporating no electrical regulation system, for an internal combustion engine which keeps the cylinder block of the internal combustion engine considerably warm during operation thereof, thus keeping emission of noxious components in the exhaust gases of the internal combustion engine low.

It is a further object of the present invention to provide a cooling system, and a valve assembly therefor, incorporating no electrical regulation system, for an internal combustion engine which warms up the lubricating oil in the cylinder block of the engine quickly from the engine cold condition, and which thereafter keeps this lubricating oil hot.

It is a further object of the present invention to provide a cooling system, and a valve assembly therefor, incorporating no electrical regulation system, for an internal combustion engine which, by warming up the cylinder block of the internal combustion engine quickly from the cold condition, and by keeping it warm during operation of the internal combustion engine, minimizes frictional energy losses in the engine.

It is a yet further object of the present invention to provide a cooling system, and a valve assembly therefor, incorporating no electrical regulation system, for an internal combustion engine which minimizes engine warming up time.

It is a yet further object of the present invention to provide a cooling system, and a valve assembly therefor, incorporating no electrical regulation system, for an internal combustion engine which minimizes engine wear during the engine warmup process of the internal combustion engine.

It is a yet further object of the present invention to provide a cooling system, and a valve assembly therefor, incorporating no electrical regulation system, for an internal combustion engine which minimizes fuel utilization during the engine warmup process of the internal combustion engine.

It is a yet further object of the present invention to provide a cooling system, and a valve assembly therefor, incorporating no electrical regulation system, for an internal combustion engine which minimizes the possibility of the cylinder block of the engine suffering thermal shock due to a sudden wave of cold cooling fluid entering a cooling jacket thereof.

It is a yet further object of the present invention to provide a cooling system, and a valve assembly therefor, incorporating no electrical regulation system, for an internal combustion engine which allows for maximum radiator cooling capacity utilization during operation of the internal combustion engine.

It is a yet further object of the present invention to provide a cooling system, and a valve assembly therefor, incorporating no electrical regulation system, for an internal combustion engine, switching of cooling fluid in which is performed by a set of simple valves utilizing thermal expansion material such as thermo wax for actuation.

It is a yet further object of the present invention to provide a cooling system, and a valve therefor, for an internal combustion engine, which is cheap to produce.

It is a yet further object of the present invention to provide a cooling system, and a valve therefor, for an internal combustion engine, which is reliable during operation.

It is a yet further object of the present invention to provide a cooling system, and a valve therefor, for an internal combustion engine, which is easy to service.

It is a yet further object of the present invention to provide a cooling system, and a valve therefor, for an internal combustion engine, which can be serviced without using any particular specialized testing equipment.

According to an aspect of the present invention, these and other objects are accomplished by, for an internal combustion engine comprising: (a) a cylinder head formed with a head cooling jacket for cooling said cylinder head, said head cooling jacket being formed with a cylinder head inlet and a cylinder head outlet; (b) a cylinder block formed with a block cooling jacket for cooling said cylinder block, said block cooling jacket being formed with a cylinder block inlet and a cylinder block outlet; and (c) a radiator formed with an inlet and an outlet; a cooling system, comprising: (d) a first pump for impelling cooling fluid through said head cooling jacket from said cylinder head inlet towards said cylinder head outlet; (e) a second pump for impelling cooling fluid through said block cooling jacket from said cylinder block inlet towards said cylinder block outlet; (f) a block recirculation conduit system leading from said cylinder block outlet of said block cooling jacket so as to supply flow of cooling fluid, from a downstream part of said block recirculation conduit system, to said cylinder block inlet of said block cooling jacket; (g) a main recirculation conduit system, an upstream part of which is communicated to said cylinder head outlet of said head cooling jacket, and a downstream part of which is communicated to said inlet of said radiator; (h) a radiator output conduit system, leading from said outlet of said radiator to said cylinder head inlet of said head cooling jacket; (i) a first junction assembly between said block recirculation conduit system and said main recirculation conduit system at upstream parts thereof, which at least sometimes allows flow between said part of said block recirculation conduit system and said part of said main recirculation conduit system; (j) a second junction assembly between a downstream part of said block recirculation conduit system and a part of said radiator output conduit system, which at least sometimes allows flow between said part of said block recirculation conduit system and said part of said radiator output conduit system; (k) and a mechanical non-electrical control valve assembly which is incorporated in one of said first junction assembly and said second junction assembly and which controls the allocation of flow through said head cooling jacket and flow through said block cooling jacket between said block recirculation conduit system and said main recirculation conduit system, according to a set of parameters which include the temperature of the cooling fluid passing out of said block cooling jacket; said control valve assembly: when it detects a temperature of the cooling fluid flow passing out of said block cooling jacket of less than a first predetermined temperature, being so switched that it directs substantially all the cooling fluid flow through said head cooling jacket which is passing out through said cylinder head outlet and also substantially all the cooling fluid flow through said block cooling jacket which is passing out through said cylinder block outlet to flow into said upstream part of said block recirculation conduit system, said two cooling fluid flows being mixed within said block recirculation conduit system, not directing any substantial cooling fluid flow to flow into said upstream part of said main recirculation conduit system; when it detects a temperature of the cooling fluid passing out of said block cooling jacket of greater than said first predetermined temperature but less than a second predetermined temperature greater than said first predetermined temperature, being switched so that it directs substantially all the cooling fluid flow through said head cooling jacket which is passing out through said cylinder head outlet to flow into said upstream part of said main recirculation conduit system and through said radiator, and so that it directs substantially all the cooling fluid flow through said block cooling jacket which is passing out through said cylinder block outlet to flow into said upstream part of said block recirculation conduit system, and, when it detects a temperature of the cooling fluid passing out of said block cooling jacket of greater than said second predetermined temperature, being so switched that it directs substantially all the cooling fluid flow through said head cooling jacket which is passing out through said cylinder head outlet and also substantially all the cooling fluid flow through said block cooling jacket which is passing out through said cylinder block outlet to flow into said upstream part of said main recirculation conduit system and through said radiator, said two cooling fluid flows being mixed within said main recirculation conduit system and within said radiator, not directing any substantial cooling fluid flow into said upstream part of said block recirculation conduit system.

According to such a structure, before said internal combustion engine has warmed up to said first predetermined temperature: all of said cooling fluid flowing through said head cooling jacket and also all of said cooling fluid flowing through said block cooling jacket pass out of said cylinder head outlet and said cylinder block outlet respectively, then meet in said first junction assembly and both enter into said block recirculation conduit system, then flow down said block recirculation conduit system and diverge in said second junction assembly, said head jacket cooling fluid flow then entering into said radiator output conduit system and passing to said cylinder head inlet, while said block jacket cooling fluid flow passes down said block recirculation conduit system to said cylinder block inlet, neither of said cooling fluid flows therefore passing through said radiator so that neither of them is substantially cooled; when said internal combustion engine has been warmed up to a temperature above said first predetermined temperature but below said second predetermined temperature: said cooling fluid flowing through said head cooling jacket passes out of said cylinder head outlet and past said first junction assembly to flow down said main recirculation conduit system, through said radiator wherein it is cooled, down said radiator output conduit system, past said second junction assembly, and down said radiator output conduit system to said cylinder block inlet, while said cooling fluid flowing through said block cooling jacket passes out of said cylinder block outlet and past said first junction assembly to flow down said block recirculation conduit system, past said second junction assembly, and down said block recirculation conduit system to said cylinder block inlet, not being substantially cooled; and, after said internal combustion engine has been warmed up to a temperature above said second predetermined temperature, all of said cooling fluid flowing through said head cooling jacket and also all of said cooling fluid flowing through said block cooling jacket pass out of said cylinder head outlet and said cylinder block outlet respectively, then meet in said first junction assembly and both enter into said main recirculation conduit system, pass while mixing through said radiator wherein they are cooled, and then pass down said radiator output conduit system and diverge in said second junction assembly, said head jacket cooling fluid flow then continuing down said radiator output conduit system and passing to said cylinder head inlet, while said block jacket cooling fluid flow passes down said block recirculation conduit system to said cylinder block inlet, both of said cooling fluid flows therefore passing through said radiator so that both of them are substantially cooled.

Another aspect of the present invention is concerned with the construction of the valve assembly whose function is specified above. According to this aspect of the present invention, the above and other objects are accomplished by a control valve assembly for a cooling system for an engine, comprising: a valve casing formed with a first port, a second port, a third port, and a fourth port; a first valve element and a first valve seat cooperating with said first valve element so as to open and close a first controlled aperture through said first valve seat, said first controlled aperture being on a first fluid flow path between said first port and said third port and being the only controlled aperture thereon, and also being on a third fluid flow path between said second port and said third port; a second valve element and a second valve seat cooperating with said second valve element so as to open and close a second controlled aperture through said second valve seat, said second controlled aperture being on a second fluid flow path between said first port and said fourth port; a third valve element and a third valve seat cooperating with said third valve element so as to open and close a third controlled aperture through said third valve seat, said third controlled aperture being on said third fluid flow path between said second port and said third port, said first and third controlled apertures being the only controlled apertures on said third fluid flow path between said second port and said third port; a fourth valve element and a fourth valve seat cooperating with said fourth valve element so as to open and close a fourth controlled aperture through said fourth valve seat, said fourth controlled aperture being on a fourth fluid flow path between said second port and said fourth port and being the only controlled aperture thereon, and said fourth controlled aperture also being on said second fluid flow path between said first port and said fourth port, said second and fourth controlled apertures being the only controlled apertures on said second fluid flow path between said first port and said fourth port; a first temperature sensitive actuator exposed to sense the temperature of the fluid conducted through said second port, which, when it senses a temperature less than a first predetermined temperature, moves said first valve element so as to press said first valve element against said first valve seat and so as to close said first controlled aperture through said first valve seat, interrupting communication between said first port and said third port via said first fluid flow path and between said second port and said third port via said third fluid flow path, and moves said second valve element so as to bring said second valve element away from said second valve seat and so as to open said second controlled aperture through said second valve seat, partially establishing communication between said first port and said fourth port via said second fluid flow path; and when it senses a temperature higher than said first predetermined temperature, moves said first valve element so as to bring said first valve element away from said first valve seat and so as to open said first controlled aperture through said first valve seat, establishing communication between said first port and said third port via said first fluid flow path and partially establishing communication between said second port and said third port via said third fluid flow path, and moves said second valve element so as to press said second valve element against said second valve seat and so as to close said second controlled aperture through said second valve seat, interrupting communication between said first port and said fourth port via said second fluid flow path; a second temperature sensitive actuator exposed to sense the temperature of the fluid conducted through said second port, which, when it senses a temperature less than a second predetermined temperature which is higher than said first predetermined temperature, moves said third valve element so as to press said third valve element against said third valve seat and so as to close said third controlled aperture through said third valve seat, interrupting communication between said second port and said third port via said third flow path, and moves said fourth valve element so as to bring said fourth valve element away from said fourth valve seat and so as to open said fourth controlled aperture through said fourth valve seat, establishing communication between said second port and said fourth port via said fourth fluid flow path and partially establishing communication between said first port and said fourth port via said second fluid flow path; and when it senses a temperature higher than said second predetermined temperature, moves said third valve element so as to bring said third valve element away from said third valve seat and so as to open said third controlled aperture through said third valve seat, partially establishing communication between said second port and said third port via said third fluid flow path, and moves said fourth valve element so as to press said fourth valve element against said fourth valve seat and so as to close said fourth controlled aperture through said fourth valve seat, interrupting communication between said second port and said fourth port via said fourth fluid flow path and interrupting communication between said first port and said fourth port via said second fluid flow path.

According to such a structure, this valve assembly can adequately fulfil its function as described above, without the use of any electrical parts or any electrical control system, but merely by the use of the above described two temperature sensitive actuators, which are per se well known and are generally very reliable, cheap, and easy to replace and service.

BRIEF DESCRIPTION OF THE DRAWINGS

The present invention will now be shown and described with reference to several preferred embodiments thereof, and with reference to the illustrative drawings. It should be clearly understood, however, that the description of the embodiments, and the drawings, are all of them given purely for the purposes of explanation and exemplification only, and are none of them intended to be limitative of the scope of the present invention in any way, since the scope of the present invention is to be defined solely by the legitimate and proper scope of the appended claims. In the drawings:

DESCRIPTION OF THE PREFERRED EMBODIMENTS

The present invention will now be described with reference to several preferred embodiments thereof, and with reference to the appended drawings.

GENERAL CONSTRUCTION OF THE FIRST PREFERRED EMBODIMENT

Figure 1:
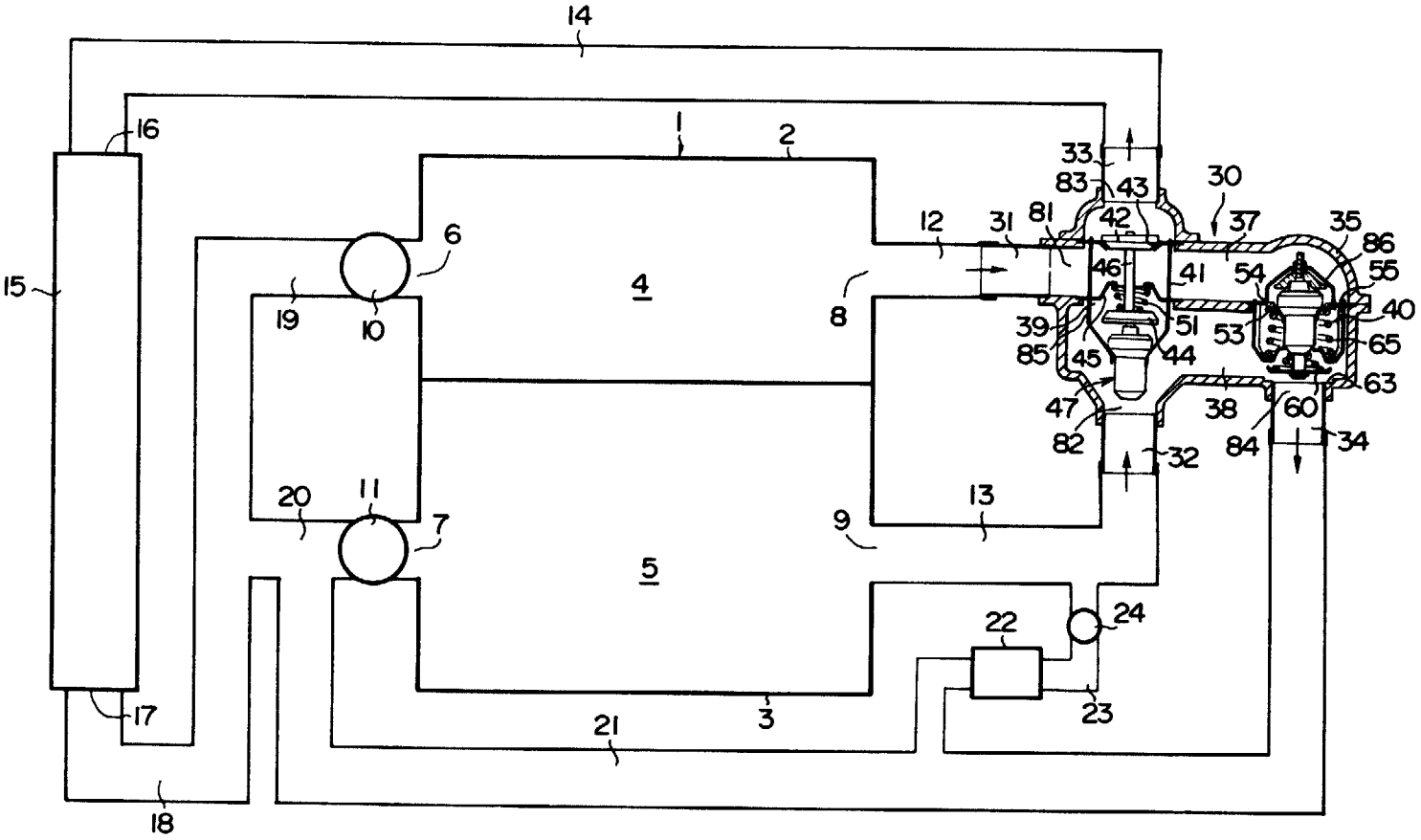
FIG. 1 is a part diagrammatical part cross sectional illustration, showing diagrammatically the basic parts of a cooling system which is a first preferred embodiment of the cooling system according to the present invention, and also showing in sectional form a valve assembly incorporating a pair of temperature sensitive valves which is comprised in this first preferred embodiment and which in this first preferred embodiment is installed near the outlets of the head and block cooling jackets, so as to control the flows of cooling fluid through these cooling jackets and through a radiator.

FIG. 1 is a diagrammatical view, showing an internal combustion engine which is equipped with a preferred embodiment of the cooling system and valve according to the present invention. In this figure, the reference numeral 1 denotes the internal combustion engine, which comprises a cylinder head 2 and a cylinder block 3, which are clamped together, optionally with the intervention therebetween of a cylinder head gasket which is not shown.

The internal combustion engine 1 includes at least one combustion chamber, which is not shown, and the cylinder head 2 defines the upper part of this combustion chamber, i.e. the part thereof in which the compression and the ignition occurs, and the surface of which upper part therefore receives the greater proportion of the heat generated in said combustion chamber. The cylinder head 2 is formed with a head cooling jacket 4 which extends close to a large part of said upper part of said combustion chamber, so as, when said head cooling jacket 4 is filled with cooling fluid such as water, to cool said upper part of said combustion chamber, and said cylinder head 2. Typically, the internal combustion engine 1 will in fact include several such combustion chambers, and the head cooling jacket 4 will extend past the upper parts of each of these combustion chambers. Cooling fluid is supplied into the head cooling jacket 4 through a cylinder head inlet 6, and is taken out from the head cooling jacket 4 through a cylinder head outlet 8.

Similarly, the cylinder block 3 is formed with a block cooling jacket 5 which extends close to a large part of the side wall defining surface of said combustion chamber, so as, when said block cooling jacket 5 is filled with cooling fluid, to cool said side wall part of said combustion chamber, and said cylinder block 3. Again, of course, typically the cylinder block 3 will in fact define several such combustion chamber walls or bores, and the block cooling jacket 5 will extend past the side wall parts of each of these bores. Cooling fluid is supplied into the block cooling jacket 5 through a cylinder block inlet 7, and is taken out from the block cooling jacket 5 through a cylinder block outlet 9.

Further, a cooling radiator 15 of a conventional sort, formed with an inlet 16 positioned at an upper portion thereof and an outlet 17 positioned at a lower portion thereof, is provided for the internal combustion engine 1.

As has been previously explained, during operation of the internal combustion engine 1, the major portion of the heat generated in the combustion chambers thereof is communicated to the cylinder head 2, and only a minor portion of the heat generated in the combustion chambers is communicated directly to the cylinder block 3 of the internal combustion engine 1. Therefore, an imbalance of heating occurs between the cylinder head 2 and the cylinder block 3, and a first preferred embodiment of the cooling system and valve according to the present invention for cooling the internal combustion engine 1, which corrects said imbalance, will now be explained.

A cylinder head pump 10 is provided proximate to the cylinder head inlet 6, for impelling cooling fluid through the head cooling jacket 4 from the cylinder head inlet 6 to the cylinder head outlet 8; and, similarly, a cylinder block pump 11 is provided, proximate to the cylinder block inlet 7, for impelling cooling fluid through the block cooling jacket 5 from the cylinder block inlet 7 to the cylinder block outlet 9. To the cylinder head outlet 8 there is connected the upstream end of a head output conduit 12, and to the cylinder block outlet 9 there is connected the upstream end of a block output conduit 13.

The downstream end, i.e. the end remote from the internal combustion engine 1, of the head output conduit 12 is connected to the upstream end of a first union pipe 31, the downstream end of which is connected to a first inlet port 81 of a valve assembly 30 which will be explained in detail later. The downstream end, i.e. the end remote from the internal combustion engine 1, of the block output conduit 13 is connected to the upstream end of a second union pipe 32, the downstream end of which is connected to a second inlet port 82 of said valve assembly 30. A first outlet port 83 of said valve assembly 30 is connected to the upstream end of a third union pipe 33, the downstream end of which is connected to the upstream end of a main recirculation conduit 14. Finally, a second outlet port 84 of said valve assembly 30 is connected to the upstream end of a fourth union pipe 34, the downstream end of which is connected to the upstream end of a block recirculation conduit 21.

The downstream end of said main recirculation conduit 14 is connected to the inlet 16 of the radiator 15, and the outlet 17 of the radiator 15 is connected to the upstream end of a radiator output conduit 18, whose downstream end is connected to the upstream end of a head input conduit 19 and also is connected to the upstream end of a block input conduit 20. The downstream end of the head input conduit 19 is directly connected to the input of the cylinder head pump 10, and the downstream end of the block input conduit 20 is connected to the input of the cylinder block pump 11.

To an intermediate point of the block output conduit 13 there is connected the upstream end of a heater feed conduit 23, at an intermediate point of which there is provided a heater flow regulation valve 24, which selectively can regulate the flow rate of cooling fluid through said heater feed conduit 23; downstream of the heater flow regulation valve 24 in the heater feed conduit 23 there is provided a heater 22; and the downstream end of the heater feed conduit 23 is connected to an intermediate point of the block recirculation conduit 21. Thus the heater 22 can be fed, via the heater feed conduit 23, with part of the cooling fluid flow which is available in the block output conduit 13, in a selective manner under the control of the heater flow regulation valve 24. Finally, the downstream end of the block recirculation conduit 21 is connected to an intermediate part of the block input conduit 20, and accordingly the block recirculation conduit 21, via the valve assembly 30 as will be seen hereinafter, can communicate the cylinder block outlet 9 to the inlet of the cylinder block pump 11, bypassing the radiator 15.

THE PARTICULAR CONSTRUCTION OF THE VALVE ASSEMBLY 30 IN THE FIRST PREFERRED EMBODIMENT

Figure 2:
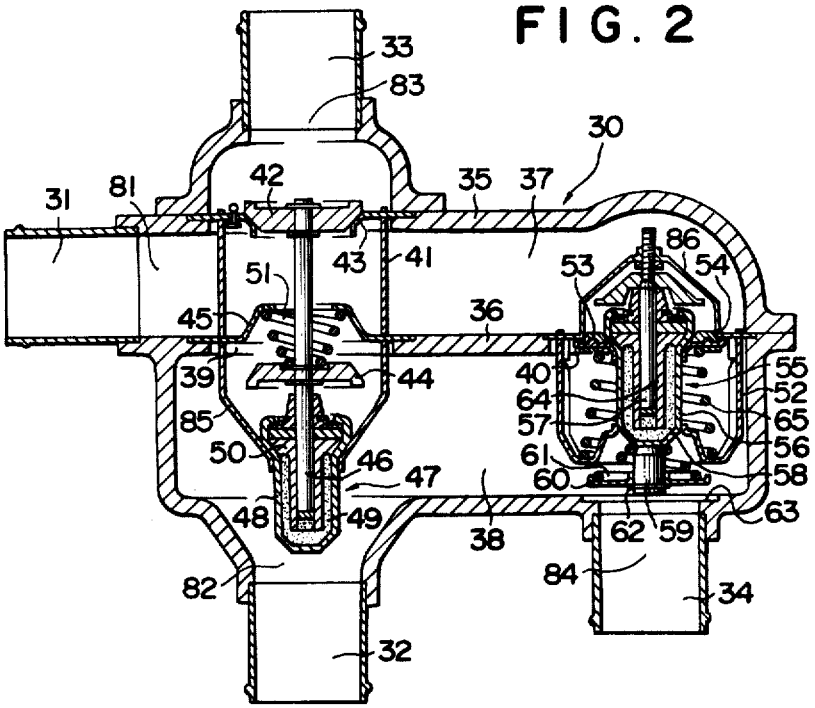
FIG. 2 is an enlarged sectional view of said valve assembly (shown in FIG. 1 in general view) incorporating a pair of temperature sensitive valves which is comprised in the first preferred embodiment of the present invention, in said valve assembly a first and a second valve element being fixed to a valve shaft.

Now, the particular construction of the valve assembly 30 used in this first preferred embodiment of the present invention will be explained in detail. FIG. 2 is a cross sectional view of said valve assembly 30, and of a first control valve 85 and a second control valve 86 incorporated in said valve assembly 30 in this first preferred embodiment, seen as enlarged from the view thereof presented in FIG. 1.

This valve assembly 30 comprises a valve assembly casing 35, which in fact may be formed from several joined pieces. This valve assembly casing 35 is formed with the abovementioned first inlet port 81, second inlet port 82, first outlet port 83, and second outlet port 84, which respectively are connected to the first, second, third, and fourth union pipes 31, 32, 33, and 34, so that the valve assembly 30 as a whole is easily detachable from the cooling system of the vehicle for replacement, servicing, and the like. Within the valve assembly casing 35 there are defined an upper chamber 37 and a lower chamber 38, both as seen in the sense of FIGS. 1 and 2, these chambers 37 and 38 being separated by a partition wall 36, which is formed with a first communication port 39 and a second communication port 40 pierced through it. The opening and closing of the first communication port 39, which communicates the upper chamber 37 and the lower chamber 38, and of the first outlet port 83, are regulated, as will be seen in detail shortly, by the action of the aforementioned first control valve 85; and the opening and closing of the second communication port 40, which also communicates the upper chamber 37 and the lower chamber 38, and of the second outlet port 84, are regulated, as will also be seen in detail shortly, by the action of the aforementioned second control valve 86. The central axis of the first communication port 39 is coincident with the central axis of the first outlet port 83, and the central axis of the second communication port 40 is coincident with the central axis of the second outlet port 84.

Now the construction of the first control valve 85 which controls the opening and closing of the first communication port 39 and of the first outlet port 83 will be described. A valve frame 41 is fixed within the valve assembly casing 35 so as to block the first communication port 39 and an inner part of the first outlet port 83. This valve frame 41 is of a generally hollow cylindrical form with openings formed through its sides (although these openings cannot in fact be seen in the figures) so that communication between the inside of the valve frame 41 and the outside thereof is freely established. To the inner part of said valve frame 41 there are fixed as generally coaxial with the first communication port 39 and the first outlet port 83 two generally annular valve seats: a first annular valve seat 43 the circular opening through which opens between the upper chamber 37 and the first outlet port 83, and a second annular valve seat 45 the circular opening through which opens between the upper chamber 37 and the lower chamber 38.

A first disk shaped valve element 42 cooperates with the first annular valve seat 43 so as selectively to establish and to break communication between the first outlet port 83 and the upper chamber 37, and a second disk shaped valve element 44 cooperates with the second annular valve seat 45 so as selectively to establish and break communication between the upper chamber 37 and the lower chamber 38. In this first preferred embodiment of the cooling system and valve according to the present invention, the first valve element 43 is fixed to a rod shaped valve shaft 46 at the upper end thereof in FIG. 2, in a coaxial relationship therewith, and the second valve element 44 is fixed to said valve shaft 46 at an intermediate position therealong, also in a coaxial relationship therewith. Thus, in this first preferred embodiment, the first and second valve elements 43 and 44 and the valve shaft 46 are all fixed together, and move together. This combination of the first and second valve elements 43 and 44 and the valve shaft 46 is biased in the downward direction in FIG. 2 by a compression coil spring 51, the upper end of which for convenience bears against a part of the second valve seat 45, although this is not essential to the present invention.

The lower end in FIG. 2 of the valve shaft 46 extends into and is guided by a guide member 50 which is incorporated in a temperature sensitive valve actuator generally designated by the reference numeral 47. The outer shell 48 of this temperature sensitive valve actuator 47 is fixed in the lower part in FIG. 2 of the valve frame 41, within the lower chamber 38, and within this outer shell 48 there is held a mass 49 of thermally expansible material such as so called thermowax. The mass of thermally expansible material 49 is sealed within the inside of the temperature sensitive valve actuator 47, and is communicated to the lower end of the valve shaft 46.

The operation of this first control valve 85 is as follows. When the temperature of the cooling fluid within the lower chamber 38 is below a predetermined first temperature which for example in this first preferred embodiment may be 80° C., then the temperature of said mass of thermally expansible material 49 is also below said predetermined first temperature, and at this time said mass of thermally expansible material 49 is in a solid state and does not exert significant pressure on the lower end of the valve shaft 46, and therefore the valve shaft 46 and the first valve element 42 and the second valve element 44 which are attached thereto are positioned, by the biasing action of the compression coil spring 50, to their lower positions in which they are shown in FIG. 2, wherein the first valve element 42 is seated against the first valve seat 43 and closes the circular hole therethrough thus breaking communication between the upper chamber 37 and the first outlet port 83, i.e. blocking said first outlet port 83, and wherein the second valve element 44 is moved away from the second valve seat 45 and opens the circular hole therethrough thus establishing communication between the upper chamber 37 and the lower chamber 38, i.e. opening said first communication port 39. On the other hand, when the temperature of the cooling fluid within the lower chamber 38 rises above said predetermined first temperature which for example in this first preferred embodiment has been taken as 80° C., then the temperature of said mass of thermally expansible material 49 also rises above said predetermined first temperature, and at this time said mass of thermally expansible material 49 melts and comes to be in the liquid state and expands very substantially, thus coming to exert significant pressure on the lower end of the valve shaft 46, and therefore the valve shaft 46 and the first valve element 42 and the second valve element 44 which are attached thereto are now positioned, against the biasing action of the compression coil spring 51 which is overcome, to their upper positions in the sense of FIG. 2, wherein the first valve element 42 is moved away from the first valve seat 43 and opens the circular hole therethrough thus establishing communication between the upper chamber 37 and the first outlet port 83, i.e. opening said first outlet port 83, and wherein the second valve element 44 is seated against the second valve seat 45 and closes the circular hole therethrough thus breaking communication between the upper chamber 37 ane the lower chamber 38, i.e. blocking said first communication port 39.

Now the construction of the second control valve 86 which controls the opening and closing of the second communication port 40 and of the second outlet port 84 will be described. A valve frame 52 is fixed within the valve assembly casing 35 so as to block the second communication port 40, but, in the case of this second control valve 86, not to block any inner part of the second outlet port 84. This valve frame 52 is again of a generally hollow cylindrical form with openings formed through its sides (although again these openings cannot in fact be seen in the figures) so that communication between the inside of the valve frame 52 and the outside thereof is freely established. To the inner part of said valve frame 52 there is fixed as generally coaxial with the second communication port 40 and the second outlet port 84 a generally annular first valve seat 54, the circular opening through which opens between the upper chamber 37 and the lower chamber 38, and there is formed around an inner part of the second outlet port 84 a second annular valve seat 63 the circular opening through which opens between the lower chamber 38 and the second outlet port 84.

A first annular valve element 53 cooperates with the first annular valve seat 54 so as selectively to establish and to break communication between the upper chamber 37 and the lower chamber 38, and a second disk shaped valve element 60 cooperates with the second annular valve seat 63 so as selectively to establish and break communication between the lower chamber 38 and the second outlet port 84. In this preferred embodiment of the cooling system and valve according to the present invention, this first annular valve element 54 is fixed around the outside of the outer shell 56 of a temperature sensitive valve actuator generally designated by the reference numeral 55, as generally coaxial with the second communication port 40 and the second outlet port 84, so as to seal against said outside of said outer shell 56. To the lower end in FIG. 2 of this outer shell 56 of this temperature sensitive valve actuator 55 there is fixed the upper end of a valve shaft 59, to the lower end of which there is slidably mounted, also as generally coaxial with the second communication port 40 and the second outlet port 84, said second disk shaped valve element 60; and said second disk shaped valve element 60 is biased in the downward direction in FIG. 2, relative to the valve shaft 59, by a compression coil spring 61, movement of said disk shaped valve element 60 downwards in FIG. 2 along the valve shaft 59 being finally arrested by it coming into contact with a snap ring 62 fitted on the valve shaft 59. Thus, in this first preferred embodiment, also, the first and second valve elements 53 and 60, the outer shell 56 of the temperature sensitive valve actuator 55, and the valve shaft 59 are all fixed together, and move together, provided that the second disk shaped valve element 60 is not displaced from its extreme position downwards in the figure along said valve shaft 59 wherein it rests against the snap ring 62 by compressing the compression coil spring 61. This combination of the first and second valve elements 53 and 60, the outer shell 56 of the temperature sensitive valve actuator 55, and the valve shaft 59 is biased in the upward direction in FIG. 2 by a compression coil spring 65, the lower end of which bears against a part of the valve frame 52.

Thus the lower part of the outer shell 56 of the temperature sensitive valve actuator 55 is located in the lower part in FIG. 2 of the valve frame 52, within the lower chamber 38, and within this lower part of the outer shell 56 there is held a mass 58 of thermally expansible material such as so called thermowax, the melting point of which as will be seen hereinafter is substantially higher than the melting point of the mass 49 of thermally expansible material in the first control valve 85. This mass of thermally expansible material 58 is sealed within the inside of the temperature sensitive valve actuator 55, and is communicated to the lower end in FIG. 2 of a valve needle 57, the upper part of which in FIG. 2 extends through and is guided by a guide member 64 which is incorporated in the temperature sensitive valve actuator 55. Finally, the upper end in FIG. 2 of the valve needle 57 is fixed to the upper part of the valve frame 52 by an adjustable screw system, which is visible in the drawing but which will not be particularly described here, and which is used for adjustment purposes.

The operation of this second control valve 86 is as follows. When the temperature of the cooling fluid within the lower chamber 38 is below a predetermined second temperature which for example in this first preferred embodiment may be 95° C., and which in any case is substantially higher than the predetermined first temperature, exemplarily 80° C., which is the melting point of the mass 49 of thermally expensible material in the first control valve 85, then the temperature of said mass of thermally expansible material 58 is also below said predetermined second temperature, and at this time said mass of thermally expensible material 58 is in a solid state and does not exert significant pressure on the lower end of the valve needle 57, and therefore the outer shell 56 of the temperature sensitive valve actuator 55, the first valve element 53, the valve shaft 59, and the second valve element 60 are positioned, by the biasing action of the compression coil spring 65, to their upper positions in which they are shown in FIG. 2, wherein the first valve element 53 is seated against the first valve seat 54 and closes the circular hole therethrough thus breaking communication between the upper chamber 37 and the lower chamber 38, i.e. blocking said second communication port 40, and wherein the second valve element 60 is moved away from the second valve seat 63 and opens the circular hole therethrough thus establishing communication between the lower chamber 38 and the second outlet port 84, i.e. opening said second outlet port 84. On the other hand, when the temperature of the cooling fluid within the lower chamber 38 rises above said predetermined second temperature which for example in this first preferred embodiment has been taken as 95° C., then the temperature of said mass of thermally expansible material 58 also rises above said predetermined second temperature, and at this time said mass of thermally expansible material 58 melts and comes to be in the liquid state and expands very substantially, thus coming to exert significant pressure on the lower end of the valve needle 57, and therefore the outer shell 56 of the temperature sensitive valve actuator 55, the first valve element 53, the valve shaft 59, and the second valve element 60 are now positioned, against the biasing action of the compression coil spring 65 which is overcome, to their lower positions in the sense of FIG. 2, wherein the first valve element 53 is moved away from the first valve seat 54 and opens the circular hole therethrough thus establishing communication between the upper chamber 37 and the lower chamber 38, i.e. opening said second communication port 40, and wherein the second valve element 60 is seated against the second valve seat 63 and closes the circular hole therethrough thus breaking communication between the the lower chamber 38 and the second outlet port 84, i.e. closing said second outlet port 84. During this downward positioning action, if the force exerted by the mass of thermally expansible material 58 becomes sufficiently great, then the second valve element 60 will be driven away from the snap ring 62 upwards in the sense of FIG. 2 relative to the valve shaft 59 against the biasing action of the compression coil spring 61 which is overcome; but this will make substantially no difference to the action of the second control valve 86.

THE OPERATION OF THE FIRST PREFERRED EMBODIMENT

Now, the operation of the first preferred embodiment of the cooling system and valve according to the present invention described above will be explained.

First, if the cooling fluid passing out from the cylinder block outlet 9 is at less than the first predetermined temperature value, which has been taken exemplarily as 80° C., then it is considered, according to the operation of this first preferred embodiment of the cooling system and valve according to the present invention, that the internal combustion engine 1 is being warmed up from the cold condition. At this time, the valve assembly 30 is in the state shown in FIG. 2.

That is to say, the temperature of said mass of thermally expansible material 49 in the first control valve 85 is also below said predetermined first temperature of 80° C., and at this time said mass of thermally expansible material 49 is in a solid state and does not exert significant pressure on the lower end of the valve shaft 46, and therefore the valve shaft 46 and the first valve element 42 and the second valve element 44 which are attached thereto are positioned, by the biasing action of the compression coil spring 51, to their lower positions in which they are shown in FIG. 2, wherein the first valve element 42 is seated against the first valve seat 43 and closes the circular hole therethrough thus breaking communication between the upper chamber 37 and the first outlet port 83, i.e. blocking said first outlet port 83, and wherein the second valve element 44 is moved away from the second valve seat 45 and opens the circular hole therethrough thus establishing communication between the upper chamber 37 and the lower chamber 38, i.e. opening said first communication port 39. Thus, the first inlet port 81 is put out of communication from the first outlet port 83, but is communicated with the lower chamber 38.

Further, the temperature of the cooling fluid within the lower chamber 38 is of course below said predetermined second value, which has been taken exemplarily as 95° C., and thus the temperature of said mass of thermally expansible material 58 in the second control valve 86 is also below said predetermined second temperature and at this time said mass of thermally expansible material 58 is in a solid state and does not exert significant pressure on the lower end of the valve needle 57, and therefore the outer shell 56 of the temperature sensitive valve actuator 55, the first valve element 53, the valve shaft 59, and the second valve element 60 are positioned, by the biasing action of the compression coil spring 65, to their upper positions in which they are shown in FIG. 2, wherein the first valve element 53 is seated against the first valve seat 54 and closes the circular hole therethrough thus breaking communication between the upper chamber 37 and the lower chamber 38, i.e. blocking said second communication port 40, and wherein the second valve element 60 is moved away from the second valve seat 63 and opens the circular hole therethrough thus establishing communication between the lower chamber 38 and the second outlet port 84, i.e. opening said second outlet port 84. Thus, the second outlet port 84 is communicated with the lower chamber 38.

Accordingly, in this operational state, since the first outlet port 83 is kept completely closed, no fluid flow can occur at this time through the main recirculation conduit 14, the radiator 15, and the radiator output conduit 18. Therefore, the flow of cooling fluid from the cylinder head outlet 8 enters into the upper chamber 37 of the valve assembly 30 through the first inlet port 81, whence it passes through the first communication port 39 entirely into the lower chamber 38, wherein it meets the flow of cooling fluid which is passing out from the cylinder block outlet 9 through the second inlet port 82 into said lower chamber 38. These flows of cooling fluid thus flow together through the lower chamber 38, out of the second outlet port 84 which is open as stated above, along the block recirculation conduit 21, mixing therein with one another, and then flow into the intermediate portion of the block input conduit 20 to which the downstream end of the block recirculation conduit 21 is communicated. Therefrom, a part of this cooling fluid is supplied to the inlet side of the cylinder block pump 11, and also a part of this cooling fluid flows through the block input conduit 20 in the right to left direction in the figure to be supplied to the upstream end of the head input conduit 19 via the downstream portion of the radiator output conduit 18 remote from the radiator 15. From the head input conduit 19, this flow then is supplied to the inlet side of the cylinder head pump 10, which pumps it back into the head cooling jacket 4 of the cylinder head 3.

Of course, at this time, substantially no cooling action at all is provided in this mode of operation by the cooling system and valve according to the present invention to the internal combustion engine 1 as a whole, because the radiator 15 is receiving no flow of cooling fluid; and the operation of the shown first preferred embodiment of the cooling system and valve according to the present invention is only to redistribute heat which is being produced by combustion within the combustion chambers of the internal combustion engine 1 from the cylinder head 2 thereof, which directly receives most of the generated heat, to the cylinder block 3 thereof which directly receives only a minor part of the generated heat.

As a result of the above explained mode of operation, the warming up characteristic of the cylinder block 3 is much improved, as compared with the conventional case in which the cooling system for the cylinder head 2 is entirely separated from the cooling system for the cylinder block 3. Since it is desirable to raise the temperature of the cylinder block 3 fairly quickly from the cold condition, in order to minimize frictional losses during the warming up process of the internal combustion engine by heating up the lubricating oil contained within it as quickly as possible, and also in order to minimize fuel utilization during engine warmup, and in order to minimize engine wear, especially cylinder bore wear, before the engine block is fairly hot, as explained above, as well as to minimize the emission of noxious components in the exhaust gases of the engine when it is being operated in the cold condition, the above described construction according to the first preferred embodiment of the cooling system and valve according to the present invention is very advantageous.

Further, the time for the cooling fluid which passes through the heater 22 to become hot and for the heater 22 to provide heating for the passenger compartment (not shown) of the vehicle to which the internal combustion engine 1 is fitted, if the heater flow regulation valve 24 is opened and flow of cooling fluid is occurring in the heater feed conduit 23, is the same as in the case of a conventional cooling system in which the cylinder head and the cylinder block are cooled together by one cooling fluid flow circuit, and is substantially less than in the case of a cooling system such as the above detailed prior art shown in FIGS. 1 and 2, in which the cylinder head is cooled completely separately from the cylinder block.

On the other hand, if the cooling fluid passing out from the cylinder block outlet 9 is at higher than the first predetermined temperature value, which has been taken exemplarily as 80° C., then it is considered, according to the operation of this first preferred embodiment of the cooling system and valve according to the present invention, that the internal combustion engine 1 is fully warmed up from the cold condition. Suppose further for the time being that said cooling fluid passing out from the cylinder block outlet 9 is at a temperature lower than the second predetermined temperature value, which has been taken exemplarily as 95° C. At this time, the valve assembly 30 is in the state which will now be described.

The temperature of the mass of thermally expansible material 49 in the first control valve 85 is of course also above said predetermined first temperature of 80° C., and thus at this time said mass of thermally expansible material 49 is melted and is in the liquid state and has expanded very substantially as compared to its solid state, thus coming to exert significant pressure on the lower end of the valve shaft 46, and therefore the valve shaft 46 and the first valve element 42 and the second valve element 44 which are attached thereto are now positioned, against the biasing action of the compression coil spring 51 which is overcome, to their upper positions in the sense of FIG. 2, wherein the first valve element 42 is moved away from the first valve seat 43 and opens the circular hole therethrough thus establishing communication between the upper chamber 37 and the first outlet port 83, i.e. opening said first outlet port 83, and wherein the second valve element 44 is seated against the second valve seat 45 and closes the circular hole therethrough thus breaking communication between the upper chamber 37 and the lower chamber 38, i.e. blocking said first communication port 39.

Further, since the temperature of the cooling fluid within the lower chamber 38 is below said predetermined second temperature which has been exemplarily taken as 95° C., therefore the temperature of said mass of thermally expansible material 58 in the second control valve 86 is of course also below said predetermined second temperature, and thus at this time said mass of thermally expansible material 58 is in a solid state and does not exert significant pressure on the lower end of the valve needle 57, and therefore the outer shell 56 of the temperature sensitive valve actuator 55, the first valve element 53, the valve shaft 59, and the second valve element 60 are positioned, by the biasing action of the compression coil spring 65, to their upper positions in which they are shown in FIG. 2, wherein the first valve element 53 is seated against the first valve seat 54 and closes the circular hole therethrough thus breaking communication between the upper chamber 37 and the lower chamber 38, i.e. blocking said second communication port 40, and wherein the second valve element 60 is moved away from the second valve seat 63 and opens the circular hole therethrough thus establishing communication between the lower chamber 38 and the second outlet port 84, i.e. opening said second outlet port 84.

Accordingly, in this operational state, since the first communication port 39 and also the second communication port 40 are both kept completely closed, no mixing can occur between the flow of cooling fluid that is passing out of the cylinder head cooling jacket 4 through the cylinder head outlet 8 to pass into the upper chamber 37 of the valve assembly 30 through the first inlet port 81 and the flow of cooling fluid that is pssing out of the cylinder block cooling jacket 4 through the cylinder block outlet 9 to pass into the lower chamber 38 of the valve assembly 30 through the second inlet port 82.

Thus, the flow of cooling fluid which has passed through the head cooling jacket 4 and has been heated therein flows out from the cylinder head outlet 8 and enters into the upper chamber 37 of the valve assembly 30 through the first inlet port 81, whence it passes through the first outlet port 83 which as mentioned above is open, into the main recirculation conduit 14 to flow down to its downstream end, whence it enters into the inlet 16 of the radiator 15. This flow of cooling fluid is then cooled within the radiator 15 in a per se well known fashion, and passes out of the outlet 17 of the radiator 15 into the upstream end of the radiator output conduit 18, along which it flows, and from the downstream end of which it passes into the upstream end of the head input conduit 19. Then, this cooling fluid passes through the head input conduit 19 to be supplied to the inlet of the cylinder head pump 10, which pumps it into the cylinder head inlet 6, whence it is returned to the head cooling jacket 4.

On the other hand, the flow of cooling fluid which has passed through the block cooling jacket 5 and has been heated therein flows out from the cylinder block outlet 9 enters into the lower chamber 37 of the valve assembly 30 through the second inlet port 82, whence it passes through the second outlet port 84 which as mentioned above is open, into the block recirculation conduit 21 to flow down to its downstream end, whence it enters into the upstream end of the block input conduit 20. Then, this cooling fluid passes through the block input conduit 20 to be supplied to the inlet of the cylinder block pump 11, which pumps it into the cylinder block inlet 7, whence it is returned to the block cooling jacket 5.

Of course, at this time, substantially no cooling action at all is provided in this mode of operation by the cooling system and valve according to the present invention to the cylinder block 3, because the cylinder block 3 is receiving no flow of cooling fluid which has passed through the radiator 15; and the operation of the shown first preferred embodiment of the cooling system and valve according to the present invention is only to cool the cylinder head 2 of the internal combustion engine 1, which directly receives most of the generated heat, by using the maximum cooling capacity of the radiator 15, but not to cool the cylinder block 3 which directly receives only a minor part of the generated heat.

Suppose now, on the other hand, that said cooling fluid passing out from the cylinder block outlet 9 comes to be at a higher temperature than the second predetermined temperature value, which has been taken exemplarily as 95° C. At this time, the valve assembly 30 transits to the state which will now be described.

The temperature of the mass of thermally expansible material 49 in the first control valve 85 of course remains above the predetermined first temperature of 80° C., and thus at this time said mass of thermally expansible material 49 remains melted and in the liquid state as expanded very substantially as compared to its solid state, thus continuing to exert significant pressure on the lower end of the valve shaft 46, and therefore the valve shaft 46 and the first valve element 42 and the second valve element 44 which are attached thereto remain positioned, against the biasing action of the compression coil spring 51 which is overcome, in their upper positions in the sense of FIG. 2, as previously described, wherein the first valve element 42 is moved away from the first valve seat 43 and opens the circular hole therethrough thus establishing communication between the upper chamber 37 and the first outlet port 83, i.e. opening said first outlet port 83, and wherein the second valve element 44 is seated against the second valve seat 45 and closes the circular hole therethrough thus breaking communication between the upper chamber 37 and the lower chamber 38, i.e. blocking said first communication port 39.

However, since the temperature of the cooling fluid within the lower chamber 38 now has come to be above said predetermined second temperature which has been exemplarily taken as 95° C., therefore the temperature of said mass of thermally expansible material 58 in the second control valve 85 is of course also now above said predetermined second temperature of 95° C., and thus at this time said mass of thermally expansible material 58 has melted and has come to be in the liquid state and has expanded very substantially, and thus has come to exert significant pressure on the lower end of the valve needle 57, and therefore the outer shell 56 of the temperature sensitive valve actuator 55, the first valve element 53, the valve shaft 59, and the second valve element 60 are now positioned, against the biasing action of the compression coil spring 65 which is overcome, to their lower positions in the sense of FIG. 2, wherein the first valve element 53 is moved away from the first valve seat 54 and opens the circular hole therethrough thus establishing communication between the upper chamber 37 and the lower chamber 38, i.e. opening said second communication port 40, and wherein the second valve element 60 is seated against the second valve seat 63 and closes the circular hole therethrough thus breaking communication between the upper chamber 37 and the lower chamber 38, i.e. closing said second outlet port 84. As mentioned before, during this downward positioning action, if the force exerted by the mass of thermally expansible material 58 becomes sufficiently great, then the second valve element 60 will be driven away from the snap ring 62 upwards in the sense of FIG. 2 relative to the valve shaft 59 against the biasing action of the compression coil spring 61 which is overcome; but this will make substantially no difference to the action of the second control valve 86. In this operational state, since the second outlet port 84 is now completely closed, no flow of cooling fluid can take place through the block recirculation conduit 21.

Thus, the flow of cooling fluid which has passed through the block cooling jacket 5 and has been heated therein flows out from the cylinder block outlet 9 and enters into the lower chamber 38 of the valve assembly 30 through the second inlet port 82, whence it passes through the second communication port 40 which as mentioned above is open, into the upper chamber 37, wherein it mixes with the flow of cooling fluid which has passed through the head cooling jacket 4 and has been heated therein and has flowed out from the cylinder head outlet 8 and has entered said upper chamber 37 through the first inlet port 37. These two mixed flows then pass through the first outlet port 83 which as mentioned above is open at this time, to enter the upstream end of the main recirculation conduit 14 and to flow down to its downstream end while becoming thoroughly mixed therein. This combined flow of cooling fluid then enters into the inlet 16 of the radiator 15, and is then cooled within the radiator 15 in a per se well known fashion, and passes out of the outlet 17 of the radiator 15 into the upstream end of the radiator output conduit 18, along which it flows, and from the downstream end of which it passes both into the upstream end of the head input conduit 19 and also into the upstream end of the block input conduit 20. Then a part of this cooling fluid passes through the head input conduit 19 to be supplied to the inlet of the cylinder head pump 10, which pumps it into the cylinder head inlet 6, whence it is returned to the head cooling jacket 4, and also a part of this cooling fluid passes through the block input conduit 20 to be supplied to the inlet of the cylinder block pump 11, which pumps it into the cylinder block inlet 7, whence it is returned to the block cooling jacket 5.

Of course, at this time, cooling action is provided in this mode of operation by the cooling system and valve according to this embodiment of the present invention both to the cylinder head 2 and also to the cylinder block 3, because both the cylinder head 2 and also the cylinder block 3 are receiving flow of cooling fluid which has passed through the radiator 15; and the operation of this embodiment of the cooling system and valve according to the present invention is not only to cool the cylinder head 2 of the internal combustion engine 1, which directly receives most of the generated heat, by using the maximum cooling capacity of the radiator 15, but also to cool the cylinder block 3 which directly receives only a minor part of the generated heat, but which is somewhat overheated at this time.

It should be noted that, if the heater flow regulation valve 24 is opened at this time and flow of cooling fluid is occurring in the heater feed conduit 23 and through the heater 22, then this flow of cooling fluid will pass down the block recirculation conduit 21 to be returned to the block input conduit 20 to be supplied to the inlet of the cylinder block pump 11, which pumps it into the cylinder block inlet 7, whence it is returned to the block cooling jacket 5. This flow will in any event be quite small in volume, and will not substantially affect the operation of the cooling system and valve according to the present invention; accordingly it will not be further considered here.

As a result of the above explained modes of operation, when the temperature of the cooling fluid within the lower chamber 38 which has flowed through the block cooling jacket 5 to cool it and has been heated therein and has flowed out from the cylinder block outlet 9 through the second inlet port 82 into said lower chamber 38 comes to be above said predetermined second temperature which has been exemplarily taken as 95° C. from being below said predetermined second temperature, immediately the state of the second control valve 86 alters due to the melting of the mass of thermally expansible material 58 and the second outlet port 84 which was open before is closed while the second communication port 40 which was closed before is opened; and thereby the cooling system, from the operational mode in which the cylinder head 2 alone was cooled by using the maximum cooling capacity of the radiator 15 while the cylinder block 3 was not cooled at all, transits to the operational mode wherein the cylinder head 2 and the cylinder block 3 are cooled together by the cooling fluid flows which pass through them being mixed before passing through the radiator 15 to be cooled therein. Thus, in this case, soon the temperature of the cooling fluid which has flowed through the block cooling jacket 5 to cool it and has been heated therein and has flowed out from the cylinder block outlet 9 through the second inlet port 82 into said lower chamber 38 drops and comes to be below said predetermined second temperature from being above said predetermined second temperature, and then immediately the state of the second control valve 86 alters due to the solidifying of the mass of thermally expansible material 58 and the second outlet port 84 which was closed before is opened while the second communication port 40 which was opened before is closed; and thereby the cooling system, from the operational mode in which the cylinder head 2 and the cylinder block 3 were cooled together by the cooling fluid flows which passed through them being mixed before passing through the radiator 15 to be cooled therein transits back to the operational mode wherein the cylinder head 2 alone is cooled by using the maximum cooling capacity of the radiator 15 while the cylinder block 3 is not cooled at all. Thus, in this case, soon the temperature of the cooling fluid which has flowed through the block cooling jacket 5 to cool it and has been heated therein and has flowed out from the cylinder block outlet 9 through the second inlet port 82 into said lower chamber 38 again rises and comes to be above said predetermined second temperature from being below said predetermined second temperature.

By a repetition of this to and fro action of the second control valve 86, therefore, the temperature of the cooling fluid which has flowed through the block cooling jacket 5 to cool it and has been heated therein and has flowed out from the cylinder block outlet 9 through the second inlet port 82 into said lower chamber 38 is kept quite near the second predetermined temperature of exemplarily 95° C., by said block cooling fluid flow being alternatively passed through the block recirculation conduit 21 to be recirculated to the cylinder block 3 without being substantially cooled, or being mixed with the head cooling fluid flow and passed through the radiator 15 to be cooled. Thus the temperature of the cylinder block 3 is regulated to a proper quite high value, substantially higher than the temperature of the cylinder head 2, without rising to too high a level.

Accordingly, by thus keeping the cylinder head 2 substantially cooler than the cylinder block 3 during warmed up operation of the internal combustion engine 1, the cylinder block 3 may be kept significantly hotter than is possible with a conventional cooling system in which the head cooling fluid and the block cooling fluid are both always being passed through the same radiator and are being cooled together. Further, the temperature of the lubricating oil contained within the internal combustion engine 1 is at this time at at least the temperature of the cylinder block 3, and in fact is maintained at a significantly higher temperature, due to the dissipation of mechanical energy therein. Of course, by keeping the cylinder head 2 as cool as possible, and by using as much of the capacity of the radiator 15 as possible for cooling the cylinder head 2, the possibility of the occurrence of knocking or pinking in the internal combustion engine 1 is greatly reduced. The keeping of the cylinder block 3 as hot as possible within a predetermined limit, i.e. substantially at the second predetermined temperature value, of exemplarily 95° C., ensures that frictional losses in the internal combustion engine 1 are kept as low as possible, and also is beneficial with regard to the minimization of the amount of noxious components which are emitted in the exhaust gases of the internal combustion engine.

THE SECOND PREFERRED EMBODIMENT

Now, a second preferred embodiment of the cooling system and valve according to the present invention will be described. In this second preferred embodiment, the general construction of the cooling system is exactly the same as in the first preferred embodiment as shown in FIG. 1, and hence description thereof will be omitted in the interests of economy of description. The only difference of this second preferred embodiment from the first preferred embodiment shown in FIGS. 1 and 2 is in the particular construction of the valve assembly 30, and therefore only this will be particularly described.

THE PARTICULAR CONSTRUCTION OF THE VALVE ASSEMBLY 30 IN THE SECOND PREFERRED EMBODIMENT

Figure 3:
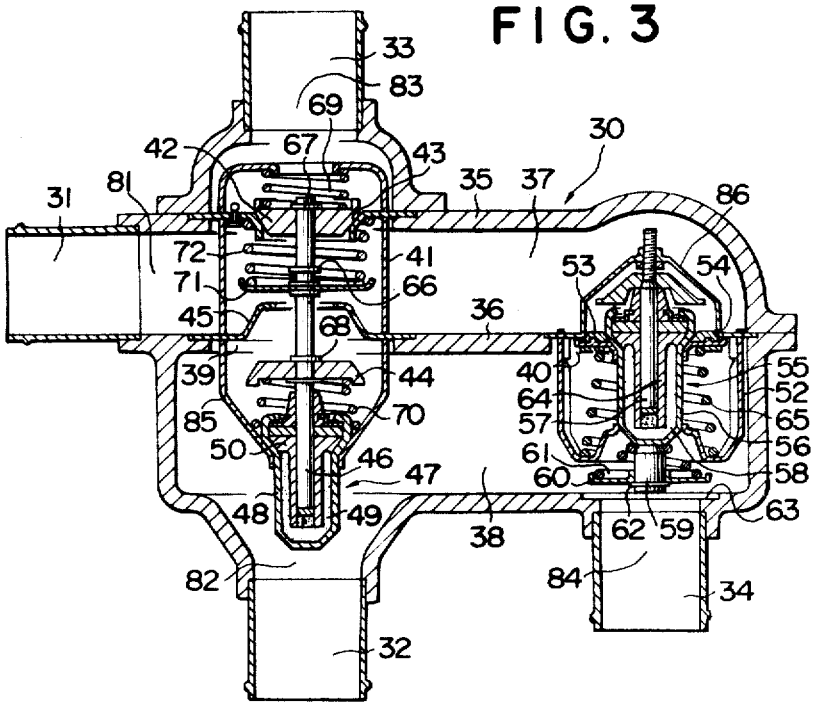
FIG. 3 is an enlarged sectional view, similar to FIG. 2, showing a different version of said valve assembly incorporating a pair of temperature sensitive valves which is comprised in a second preferred embodiment of the present invention, said second preferred embodiment being otherwise the same as the first preferred embodiment illustrated in FIGS. 1 and 2, said first and second valve elements in this second preferred embodiment being slidably mounted on said valve shaft and being biased to preferred positions relative thereto by compression coil springs.

In FIG. 3, there is shown said valve assembly 30 incorporated in the second embodiment of the cooling system and valve according to the present invention, in a cross sectional fashion similar to FIG. 2. In FIG. 3, parts, holes, and chambers of the valve assembly 30 of the second preferred embodiment shown, which correspond to parts, holes, and chambers of the valve assembly 30 of the first preferred embodiment shown in FIG. 2, and which have the same functions, are designated by the same reference numerals and symbols as in that figure.

Now, the particular construction of the valve assembly 30 used in this second preferred embodiment of the cooling system and valve according to the present invention will be explained in detail.

This valve assembly 30 comprises a valve assembly casing 35, which again in fact may be formed from several joined pieces. This valve assembly casing 35, like the valve assembly casing 35 in the first preferred embodiment, is formed with a first inlet port 81, a second inlet port 82, a first outlet port 83, and a second outlet port 84, which respectively are connected to the first, second, third, and fourth union pipes 31, 32, 33, and 34 of the cooling system (not shown), so that again the valve assembly 30 as a whole is easily detachable from the cooling system of the vehicle for replacement, servicing, and the like. Within the valve assembly casing 35 there are again defined an upper chamber 37 and a lower chamber 38, both as seen in the sense of FIG. 3, these chambers 37 and 38 being separated by a partition wall 36, which is formed with a first communication port 39 and a second communication port 40 pierced through it. The opening and closing of the first communication port 39, which communicates the upper chamber 37 and the lower chamber 38, and of the first outlet port 83, are again regulated, as will be seen in detail shortly, by the action of a first control valve 85 which is different in construction but not significantly in function from the first control valve 85 of the first preferred embodiment; and the opening and closing of the second communication port 40, which also communicates the upper chamber 37 and the lower chamber 38, and of the second outlet port 84, are regulated by the action of a second control valve 86, which is of exactly the same construction as the second control valve 86 of the first preferred embodiment, and which therefore will not be particularly described herein, in the interests of brevity of explanation. The central axis of the first communication port 39 is again coincident with the central axis of the first outlet port 83, and the central axis of the second communication port 40 is again coincident with the central axis of the second outlet port 84.

Now the construction of the first control valve 85 which controls the opening and closing of the first communication port 39 and of the first outlet port 83 will be described. A valve frame 41 is fixed within the valve assembly casing 35 so as to block the first communication port 39 and an inner part of the first outlet port 83. This valve frame 41 is of a generally hollow cylindrical form with openings formed through its sides (although these openings cannot in fact be seen in the figures) so that communication between the inside of the valve frame 41 and the outside thereof is freely established. To the inner part of said valve frame 41 there are fixed as generally coaxial with the first communication port 39 and the first outlet port 83 two generally annular valve seats: a first annular valve seat 43 the circular opening through which opens between the upper chamber 37 and the first outlet port 83, and a second annular valve seat 45 the circular opening through which opens between the upper chamber 37 and the lower chamber 38. In this second preferred embodiment, in contrast to the first preferred embodiment described above, the valve frame 41 projects somewhat past the first annular valve seat 43 upwards in FIG. 3 into the first outlet port 83, for constructional reasons which will become apparent shortly.

A first disk shaped valve element 42 cooperates with the first annular valve seat 43 so as selectively to establish and to break communication between the first outlet port 83 and the upper chamber 37, and a second disk shaped valve element 44 cooperates with the second annular valve seat 45 so as selectively to establish and break communication between the upper chamber 37 and the lower chamber 38. In this second preferred embodiment of the cooling system and valve according to the present invention, the first valve element 42 and the second valve element 44 are not fixed to the rod shaped valve shaft 46. On the contrary, the first valve element 42 is slidably mounted on the valve shaft 46 at an upper part thereof in FIG. 3 in a coaxial relationship therewith, and its travel downward in FIG. 3 relative to said valve shaft 46 is limited by a snap ring 66 mounted to the valve shaft 46 below said first valve element 42, while its travel upward in FIG. 3 relative to said valve shaft 46 is limited by a snap ring 67 mounted to the valve shaft 46 above said first valve element 42; and further the second valve element 44 is slidably mounted on the valve shaft 46 at an intermediate part thereof in FIG. 3 also in a coaxial relationship therewith, and its travel downward in FIG. 3 relative to said valve shaft 46 is limited by coming into contact with a temperature sensitive valve actuator 47 which will be described later, generally located below said second valve element 44, while its travel upward in FIG. 3 relative to said valve shaft 46 is limited by a snap ring 68 mounted to the valve shaft 46 above said second valve element 44. The valve shaft 46 is biased in the downward direction in FIG. 3 by a compression coil spring 72, the upper end of which bears against a part of the first valve seat 43, although this is not essential to the present invention, and the lower end of which bears against a spring receiving member 71 mounted to the valve shaft 46 and retained thereon by snap rings which bear no reference numbers. The first valve element 42 is biased downward in FIG. 3 toward the first valve seat 43 by a compression coil spring 69, an upper part of which bears on the aforesaid part of the valve frame 41 which protrudes into the first outlet port 83. And the second valve element 44 is biased upward in FIG. 3 toward the second valve seat 45 by a compression coil spring 70, a lower part of which bears on the aforesaid temperature sensitive valve actuator 47, and whose compression action, for a reason which will become apparent later, is weaker than the compression action of the compression coil spring 72. Thus, in this second preferred embodiment, the first and second valve elements 42 and 44 and the valve shaft 46 do not move together; but as will be seen later the valve elements 42 and 44 only move with the valve shaft 46 when they come into contact with, respectively, the snap rings 66 and 68.

The lower end in FIG. 3 of the valve shaft 46 extends into and is guided by a guide member 50 which is incorporated in a temperature sensitive valve actuator generally designated by the reference numeral 47. The outer shell 48 of this temperature sensitive valve actuator 47 is fixed in the lower part in FIG. 3 of the valve frame 41, within the lower chamber 38, and within this outer shell 48 there is held a mass 49 of thermally expansible material such as so called thermowax. The mass of thermally expansible material 49 is sealed within the inside of the temperature sensitive valve actuator 47, and is communicated to the lower end of the valve shaft 46.

The operation of this first control valve 85 is as follows. When the temperature of the cooling fluid within the lower chamber 38 is below a predetermined first temperature which for example in this second preferred embodiment may again be 80° C., then the temperature of said mass of thermally expansible material 49 is also below said predetermined first temperature, and at this time said mass of thermally expansible material 49 is in a solid state and does not exert significant pressure on the lower end of the valve shaft 46, and therefore the valve shaft 46 is biased downwards by the biasing action of the compression coil spring 72 to its lowermost position as seen in FIG. 3, the first valve element 42, being released by the snap ring 66, is biased downward by the biasing action of the compression coil spring 69 to its lowermost position as seen in FIG. 3, and the second valve element 44 is biased downward by its contact with the snap ring 68, against the compression action of the compression coil spring 70 which is overcome as stated above by the compression action of the compression coil spring 72, to its lowermost position as seen in FIG. 3; i.e., all these elements are positioned to their lower positions in which they are shown in FIG. 3, and thus the first valve element 42 is seated against the first valve seat 43 and closes the circular hole therethrough thus breaking communication between the upper chamber 37 and the first outlet port 83, i.e. blocking said first outlet port 83, and further the second valve element 44 is moved away from the second valve seat 45 and opens the circular hole therethrough thus establishing communication between the upper chamber 37 and the lower chamber 38, i.e. opening said first communication port 39. On the other hand, when the temperature of the cooling fluid within the lower chamber 38 rises above said predetermined first temperature which for example in this second preferred embodiment has been taken as 80° C., then the temperature of said mass of thermally expansible material 49 also rises above said predetermined first temperature, and at this time said mass of thermally expansible material 49 melts and comes to be in the liquid state and expands very substantially, thus coming to exert significant pressure on the lower end of the valve shaft 46, and therefore the valve shaft 46 is now positioned, against the biasing action of the compression coil spring 72 which is overcome, to its uppermost position in the sense of FIG. 3, the first valve element 42 is impelled upward by its contact with the snap ring 66 against the biasing action of the compression coil spring 69 which is overcome to an upper position in the sense of FIG. 3, and the second valve element 44, being released by the snap ring 68, is biased upward by the compression action of the compression coil spring 70 to its uppermost position in the sense of FIG. 3; and thus the first valve element 42 is moved away from the first valve seat 43 and opens the circular hole therethrough thus establishing communication between the upper chamber 37 and the first outlet port 83, i.e. opening said first outlet port 83, and further the second valve element 44 is seated against the second valve seat 45 and closes the circular hole therethrough thus breaking communication between the upper chamber 37 and the lower chamber 38, i.e. blocking said first communication port 39.

In the motion upward as seen in FIG. 3 of the valve shaft 46, it should be noted that, according to the shown positions on the valve shaft 46 of the snap rings 66 and 68, the motion of the snap ring 68 allows the second valve element 44 to become seated against the second valve seat 45 and to close the circular hole therethrough thus breaking communication between the upper chamber 37 and the lower chamber 38, i.e. blocking said first communication port 39, completely, before the motion of the snap ring 66 starts to force the first valve element 42 to move away from the first valve seat 43 and to open the circular hole therethrough thus establishing communication between the upper chamber 37 and the first outlet port 83, i.e. opening said first outlet port 83. Thus, it never can occur that both the first valve element 42 is away from the first valve seat 43 and also the second valve element 44 is away from the second valve seat 45 at the same time.

The construction and the function of the second control valve 86 which controls the opening and closing of the second communication port 40 and of the second outlet port 84 will, as mentioned above, not be particularly described, since said second control valve 86 is exactly the same in construction and function as the second control valve 86 of the first preferred embodiment.

THE OPERATION OF THE SECOND PREFERRED EMBODIMENT

Again, the operation of the second preferred embodiment of the cooling system and valve according to the present invention described above will not be particularly explained in detail, since it is substantially the same as the operation of the first preferred embodiment described above, although of course the details of the to and fro movement of the first control valve 85 differ slightly, in line with the description of the function of said first control valve given above. An advantage of this second preferred embodiment is that, in the action of the first control valve 85, since as noted above the first valve element 42 moves away from the first valve seat 43 and establishes communication between the first inlet port 81 and the first outlet port 83 only after the second valve element 44 has come into contact with the second valve seat 45 and has prevented communication between the upper chamber 37 and the lower chamber 38, thereby there is no risk of the first outlet port 83 being communicated to the lower chamber 38 via the upper chamber 37 during the movement of said first control valve 85 between its two states. If such communication should occur, there would be a risk of some of the cold cooling fluid that was contained in the main recirculation conduit 14 before the movement of the first control valve 85 being sucked into the lower chamber 38 and thence through the second outlet port 84 and along the block recirculation conduit 21 to be fed into the cylinder block cooling jacket 5, and this could cause a severe thermal shock to the cylinder block 4, which could run a risk of damaging it. However, otherwise the switching action of the first control valve 85 is substantially the same as in the first preferred embodiment; and thus the switching action of the valve assembly 30 is substantially the same, in regard to its effects on the cooling system as a whole, as the switching action of the valve assembly 30 of the first preferred embodiment; and accordingly explanation of the functioning of the second preferred embodiment of the cooling system and valve according to the present invention will be omitted in the interests of conciseness of description.

THE THIRD PREFERRED EMBODIMENT

Now, a third preferred embodiment of the cooling system and valve according to the present invention will be described. In this third preferred embodiment, the general construction of the cooling system is exactly the same as in the first preferred embodiment as shown in FIG. 1, and as in the second preferred embodiment, and hence description thereof will be omitted in the interests of economy of description. The only difference of this third preferred embodiment from the first preferred embodiment shown in FIGS. 1 and 2 and from the second preferred embodiment partially shown in FIG. 3 is in the particular construction of the valve assembly 30, and therefore only this will be particularly described.

THE PARTICULAR CONSTRUCTION OF THE VALVE ASSEMBLY 30 IN THE THIRD PREFERRED EMBODIMENT

Figure 4:
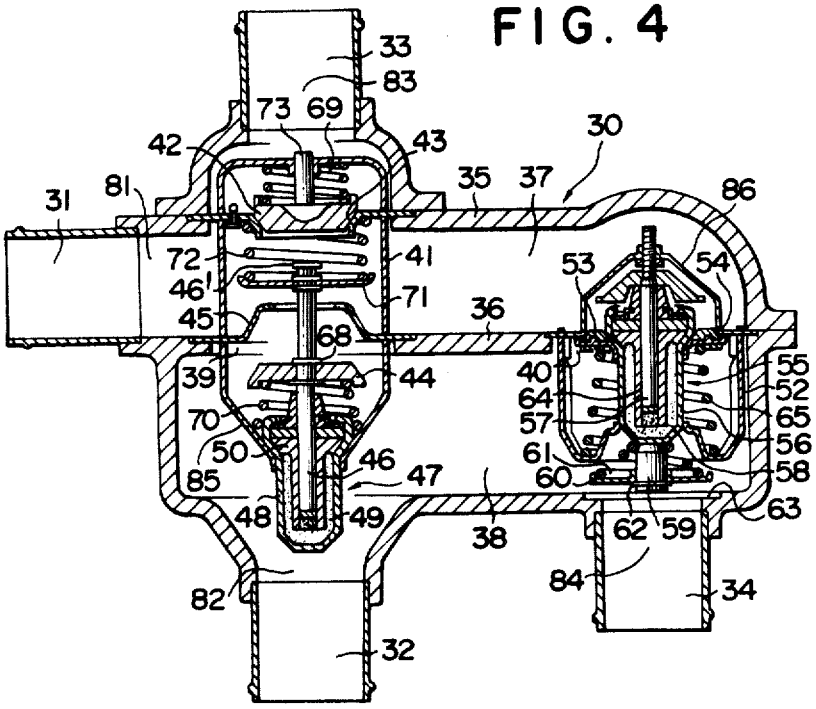
FIG. 4 is an enlarged sectional view, similar to FIGS. 2 and 3, showing another different version of said valve assembly incorporating a pair of temperature sensitive valves which is comprised in a third preferred embodiment of the present invention, said third preferred embodiment being otherwise the same as the first preferred embodiment illustrated in FIG. 1 and 2 and the second preferred embodiment, said first and second valve elements in this third preferred embodiment being mounted on two separate coaxial valve shafts.

In FIG. 4, there is shown said valve assembly 30 incorporated in the third preferred embodiment of the cooling system and valve according to the present invention, in a cross sectional fashion similar to FIG. 2 and FIG. 3. In FIG. 4, parts, holes, and chambers of the valve assembly 30 of the third preferred embodiment shown, which correspond to parts, holes, and chambers of the valve assembly 30 of the first preferred embodiment shown in FIG. 2, and of the valve assembly 30 of the second preferred embodiment shown in FIG. 3, and which have the same functions, are designated by the same reference numerals and symbols as in those figures.

Now, the particular construction of the valve assembly 30 used in this third preferred embodiment of the cooling system and valve according to the present invention will be explained in detail.

This valve assembly 30 comprises a valve assembly casing 35, which again in fact may be formed from several joined pieces. This valve assembly casing 35, like the valve assembly casing 35 in the first and second preferred embodiments, is formed with a first inlet port 81, a second inlet port 82, a first outlet port 83, and a second outlet port 84, which respectively are connected to the first, second, third, and fourth union pipes 31, 32, 33, and 34 of the cooling system (not shown), so that again the valve assembly 30 as a whole is easily detachable from the cooling system of the vehicle for replacement, servicing, and the like. Within the valve assembly casing 35 there are again defined an upper chamber 37 and a lower chamber 38, both as seen in the sense of FIG. 4, these chambers 37 and 38 being separated by a partition wall 36, which is formed with a first communication port 39 and a second communication port 40 pierced through it. The opening and closing of the first communication port 39, which communicates the upper chamber 37 and the lower chamber 38, and of the first outlet port 83, are again regulated, as will be seen in detail shortly, by the action of a first control valve 85 which is different in construction but not significantly in function from the first control valve 85 of the first and second preferred embodiments; and the opening and closing of the second communication port 40, which also communicates the upper chamber 37 and the lower chamber 38, and of the second outlet port 84, are regulated by the action of a second control valve 86, which is of exactly the same construction as the second control valve 86 of the first and second preferred embodiments, and which therefore will not be particularly described herein, in the interests of brevity of explanation. The central axis of the first communication port 39 is again coincident with the central axis of the first outlet port 83, and the central axis of the second communication port 40 is again coincident with the central axis of the second outlet port 84.

Now the construction of the first control valve 85 which controls the opening and closing of the first communication port 39 and of the first outlet port 83 will be described. A valve frame 41 is fixed within the valve assembly casing 35 so as to block the first communication port 39 and an inner part of the first outlet port 83. This valve frame 41 is of a generally hollow cylindrical form with openings formed through its sides (although these openings cannot in fact be seen in the figures) so that communication between the inside of the valve frame 41 and the outside thereof is freely established. To the inner part of said valve frame 41 there are fixed as generally coaxial with the first communication port 39 and the first outlet port 83 two generally annular valve seats: a first annular valve seat 43 the circular opening through which opens between the upper chamber 37 and the first outlet port 83, and a second annular valve seat 45 the circular opening through which opens between the upper chamber 37 and the lower chamber 38. In this third preferred embodiment, in contrast to the first preferred embodiment of the present invention described above but similarly to the second preferred embodiment, the valve frame 41 projects somewhat past the first annular valve seat 43 upwards in FIG. 2 into the first outlet port 83, for constructional reasons which will become apparent shortly.

A first disk shaped valve element 42 cooperates with the first annular valve seat 43 so as selectively to establish and to break communication between the first outlet port 83 and the upper chamber 37, and a second disk shaped valve element 44 cooperates with the second annular valve seat 45 so as selectively to establish and break communication between the upper chamber 37 and the lower chamber 38. In this third preferred embodiment of the cooling system and valve according to the present invention, the first valve element 42 and the second valve element 44 are not both mounted on such a long valve shaft as the rod shaped valve shaft 46 of the first and second preferred embodiments. On the contrary, the first valve element 42 is fixed to the lower end in FIG. 2 of a second valve shaft 73 in a coaxial relationship therewith, said second valve shaft 73 being slidably mounted in a guide hole formed at the top in the figure of the valve frame 41. On the other hand, the second valve element 44 is slidably mounted on a first valve shaft 46 at an intermediate part thereof in FIG. 4 also in a coaxial relationship therewith, and its travel downward in FIG. 4 relative to said valve shaft 46 is limited by coming into contact with a temperature sensitive valve actuator 47 which will be described later, generally located below said second valve element 44, while its travel upward in FIG. 4 relative to said valve shaft 46 is limited by a snap ring 68 mounted to the valve shaft 46 above said second valve element 44. The valve shaft 46 is biased in the downward direction in FIG. 4 by a compression coil spring 72, the upper end of which bears against a part of the first valve seat 43, although this is not essential to the present invention, and the lower end of which bears against a spring receiving member 71 mounted to the valve shaft 46 and retained thereon by snap rings which bear no reference numbers. The first valve element 42 is biased downward in FIG. 4 toward the first valve seat 43 by a compression coil spring 69, an upper part of which bears on the aforesaid part of the valve frame 41 which protrudes into the first outlet port 83. And the second valve element 44 is biased upward in FIG. 4 toward the second valve seat 45 by a compression coil spring 70, a lower part of which bears on the aforesaid temperature sensitive valve actuator 47, and whose compression action, for a reason which will become apparent later, is weaker than the compression action of the compression coil spring 72. Thus, in this third preferred embodiment, the first and second valve elements 42 and 44 and the valve shaft 46 do not move together; but as will be seen later the second valve element 44 only moves with the valve shaft 46 when it comes into contact with the snap ring 68, while the first valve element 42 only moves with the valve shaft 46 when the upper free end portion 46' of said valve shaft 46 comes into contact with the lower surface in FIG. 4 of said first valve element 42.

The lower end in FIG. 4 of the valve shaft 46 extends into and is guided by a guide member 50 which is incorporated in a temperature sensitive valve actuator generally designated by the reference numeral 47. The outer shell 48 of this temperature sensitive valve actuator 47 is fixed in the lower part in FIG. 4 of the valve frame 41, within the lower chamber 38, and within this outer shell 48 there is held a mass 49 of thermally expansible material such as so called thermowax. The mass of thermally expansible material 49 is sealed within the inside of the temperature sensitive valve actuator 47, and is communicated to the lower end of the valve shaft 46.

The operation of this first control valve 85, in this third preferred embodiment, is as follows. When the temperature of the cooling fluid within the lower chamber 38 is below a predetermined first temperature which for example in this third preferred embodiment may again be 80° C., then the temperature of said mass of thermally expansible material 49 is also below said predetermined first temperature, and at this time said mass of thermally expansible material 49 is in a solid state and does not exert significant pressure on the lower end of the valve shaft 46, and therefore the valve shaft 46 is biased downwards by the biasing action of the compression coil spring 72 to its lowermost position as seen in FIG. 4, the first valve element 42, being released by the upper free end 46' of said valve shaft 46, is biased downward by the biasing action of the compression coil spring 69 to its lowermost position as seen in FIG. 4, and the second valve element 44 is biased downward by its contact with the snap ring 68, against the compression action of the compression coil spring 70 which is overcome as stated above by the compression action of the compression coil spring 72, to its lowermost position as seen in FIG. 4; i.e., all these elements are positioned to their lower positions in which they are shown in FIG. 4, and thus the first valve element 42 is seated against the first valve seat 43 and closes the circular hole therethrough thus breaking communication between the upper chamber 37 and the first outlet port 83, i.e. blocking said first outlet port 83, and further the second valve element 44 is moved away from the second valve seat 45 and opens the circular hole therethrough thus establishing communication between the upper chamber 37 and the lower chamber 38, i.e. opening said first communication port 39. On the other hand, when the temperature of the cooling fluid within the lower chamber 38 rises above said predetermined first temperature which for example in this third preferred embodiment has been taken as 80° C., then the temperature of said mass of thermally expansible material 49 also rises above said predetermined first temperature, and at this time said mass of thermally expansible material 49 melts and comes to be in the liquid state and expands very substantially, thus coming to exert significant pressure on the lower end of the valve shaft 46, and therefore the valve shaft 46 is now positioned, against the biasing action of the compression coil spring 72 which is overcome, to its uppermost position in the sense of FIG. 4, the first valve element 42 is impelled upward by the contact of its lower surface against the free end 46' of the valve shaft 46 against the biasing action of the compression coil spring 69 which is overcome to an upper position in the sense of FIG. 4, and the second valve element 44, being released by the snap ring 68, is biased upward by the compression action of the compression coil spring 70 to its uppermost position in the sense of FIG. 4; and thus the first valve element 42 is moved away from the first valve seat 43 and opens the circular hole therethrough thus establishing communication between the upper chamber 37 and the first outlet port 83, i.e. opening said first outlet port 83, and further the second valve element 44 is seated against the second valve seat 45 and closes the circular hole therethrough thus breaking communication between the upper chamber 37 and the lower chamber 38, i.e. blocking said first communication port 39.

In the motion upward as seen in FIG. 3 of the valve shaft 46, it should be noted that, according to the shown position on the valve shaft 46 of the snap ring 68, and according to the amount of space available between the lower surface of the first valve element 42 and the upper end 46' of the valve shaft 46 when the valve shaft 46 is in its lowermost position as seen in FIG. 4, the motion of said snap ring 68 allows the second valve element 44 to become seated against the second valve seat 45 and to close the circular hole therethrough thus breaking communication between the upper chamber 37 and the lower chamber 38, i.e. blocking said first communication port 39, completely, before the upward motion in FIG. 4 of the free upper end 46' of the valve shaft 46 starts to force the first valve element 42 to move away from the first valve seat 43 and to open the circular hole therethrough thus establishing communication between the upper chamber 37 and the first outlet port 83, i.e. opening said first outlet port 83. Thus, it never can occur that both the first valve element 42 is away from the first valve seat 43 and also the second valve element 44 is away from the second valve seat 45 at the same time.

The construction and the function of the second control valve 86 which controls the opening and closing of the second communication port 40 and of the second outlet port 84 will, as mentioned above, not be particularly described, since said second control valve 86 is exactly the same in construction and function as the second control valve 86 of the first and second preferred embodiments.

THE OPERATION OF THE THIRD PREFERRED EMBODIMENT

Again, the operation of the third preferred embodiment of the cooling system and valve according to the present invention described above will not be particularly explained, since it is substantially the same as the operation of the first and second preferred embodiments described above, although of course the details of the to and fro movement of the first control valve 85 differ slightly, in line with the description of the function of said first control valve given above. An advantage of this third preferred embodiment which it shares with the second preferred embodiment is that, in the action of the first control valve 85, since as noted above the first valve element 42 moves away from the first valve seat 43 and establishes communication between the first inlet port 81 and the first outlet port 83 only after the second valve element 44 has come into contact with the second valve seat 45 and has prevented communication between the upper chamber 37 and the lower chamber 38, thereby there is no risk of the first outlet port 83 being communicated to the lower chamber 38 via the upper chamber 37 during the movement of said first control valve 85 between its two states. As remarked above, if such communication should occur, there would be a risk of some of the cold cooling fluid that was contained in the main recirculation conduit 14 before the movement of the first control valve 85 being sucked into the lower chamber 38 and thence through the second outlet port 84 and along the block recirculation conduit 21 to be fed into the cylinder block cooling jacket 5, and this could cause a severe thermal shock to the cylinder block 4, which could run a risk of damaging it. A further advantage of this third preferred embodiment is that because the first valve element 42 is not formed with any through hole through which any valve shaft such as the valve shaft 46 in the first and second embodiments is passed, thereby leakage of cooling fluid past and through the first valve element 42 is much reduced, as compared with the construction of the first and second preferred embodiments.

However, otherwise the switching action of the first control valve 85 is substantially the same as in the first and second preferred embodiments; and thus the switching action of the valve assembly 30 is substantially the same, in regard to its effects on the cooling system as a whole, as the switching action of the valve assembly 30 of the first and second preferred embodiments; and accordingly explanation of the functioning of the third preferred embodiment of the cooling system and valve according to the present invention will be omitted in the interests of conciseness of description.

THE FOURTH PREFERRED EMBODIMENT

Now, a fourth preferred embodiment of the cooling system and valve according to the present invention will be described. In this fourth preferred embodiment, the general construction of the cooling system is exactly the same as in the first preferred embodiment as shown in FIG. 1, and as in the second and third preferred embodiments, and hence description thereof will be omitted in the interests of economy of description. The only difference of this fourth preferred embodiment from the first preferred embodiment shown in FIGS. 1 and 2 and from the second and third preferred embodiments partially shown in FIGS. 3 and 4 is in the particular construction of the valve assembly 30, and therefore only this will be particularly described.

THE PARTICULAR CONSTRUCTION OF THE VALVE ASSEMBLY 30 IN THE FOURTH PREFERRED EMBODIMENT

Figure 5:
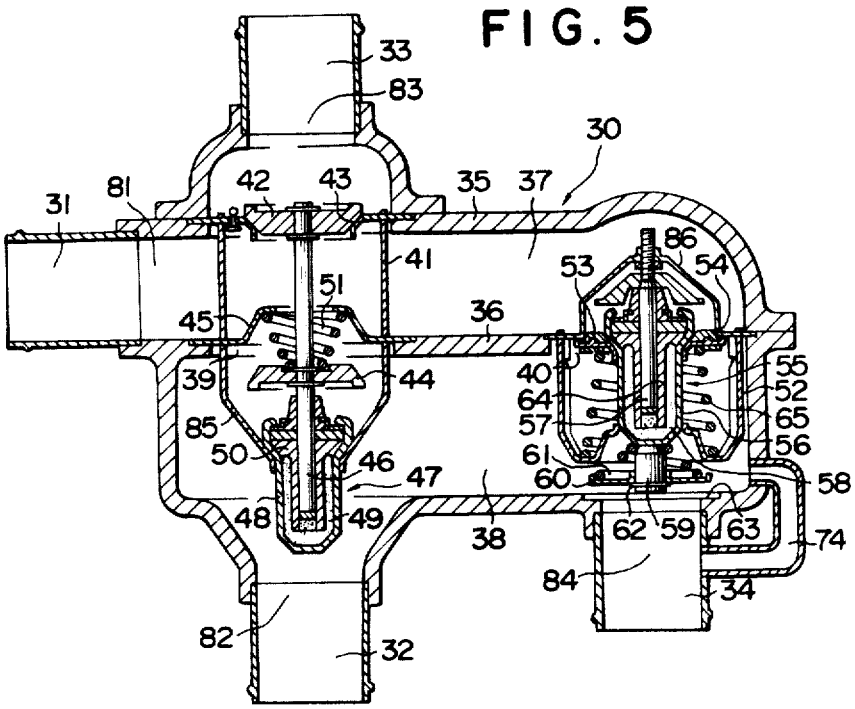
FIG. 5 is an enlarged sectional view, similar to FIGS. 2, 3, and 4, showing yet another version of said valve assembly incorporating a pair of temperature sensitive valves which is comprised in a fourth preferred embodiment of the present invention, said fourth preferred embodiment being otherwise the same as the first preferred embodiment illustrated in FIGS. 1 and 2, the second preferred embodiment, and the third preferred embodiment, said valve assembly in this fourth preferred embodiment including a bypass conduit but otherwise being the same as the valve assembly which is shown in FIG. 2 pertaining to the first preferred embodiment.

In FIG. 5, there is shown said valve assembly 30 incorporated in the fourth preferred embodiment of the cooling system and valve according to the present invention, in a cross sectional fashion similar to FIG. 2, FIG. 3, and FIG. 4. In FIG. 5, parts, holes, and chambers of the valve assembly 30 of the fourth preferred embodiment shown, which correspond to parts, holes, and chambers of the valve assembly 30 of the first preferred embodiment shown in FIG. 2, of the valve assembly 30 of the second preferred embodiment shown in FIG. 3, and of the valve assembly 30 of the third preferred embodiment shown in FIG. 4, and which have the same functions, are designated by the same reference numerals and symbols as in those figures.

The only difference between the valve assembly 30 used in this fourth preferred embodiment and the valve assembly 30 used in the first preferred embodiment of the present invention shown in FIGS. 1 and 2 is that a bypass conduit 74 is provided, of relatively high resistance to flow of cooling fluid, and leading from the lower chamber 38 to the fourth union pipe 34, just downstream of the second outlet port 34.

THE OPERATION OF THE FOURTH PREFERRED EMBODIMENT

Again, the operation of the fourth preferred embodiment of the cooling system according to the present invention described above will not be particularly explained, since it is substantially the same as the operation of the first and second preferred embodiments described above. The only difference is that the bypass conduit 74 conducts a certain flow of cooling fluid from the lower chamber 38 to the fourth union pipe 34 to flow thence into the block recirculation conduit 21, even when the second control valve 86 is interrupting all other communication between the lower chamber 38 and the second outlet port 84, which occurs, as explained above, when the temperature of the cooling fluid which has passed through the cylinder block cooling jacket 5 and which is being expelled into the lower chamber 38 is above the second predetermined temperature value of exemplarily 95° C. Thus, not all the cooling fluid which has passed through the block cooling jacket 5 and has been heated therein will be passed through the main recirculation conduit 14 to pass through the radiator 15 and to be cooled therein, but a part of this cooling fluid will be recirculated through the block recirculation conduit 21 without being cooled. Thus a lesser cooling effect is provided for the cylinder block 3, when the temperature of the cooling fluid which has flowed through the block cooling jacket 5 is approximately equal to said second predetermined temperature of exemplarily 95° C., with this fourth preferred embodiment, than with the other preferred embodiments that have been described; and thereby hunting of the cooling system at this time is reduced.

Of course, a bypass conduit like this bypass conduit 74 could be provided for the valve assemblies of the second and third preferred embodiments, shown in FIGS. 3 and 4, also; and the same beneficial effect would be attained thereby.

GENERAL CONSTRUCTION OF THE FIFTH PREFERRED EMBODIMENT

Figure 6:
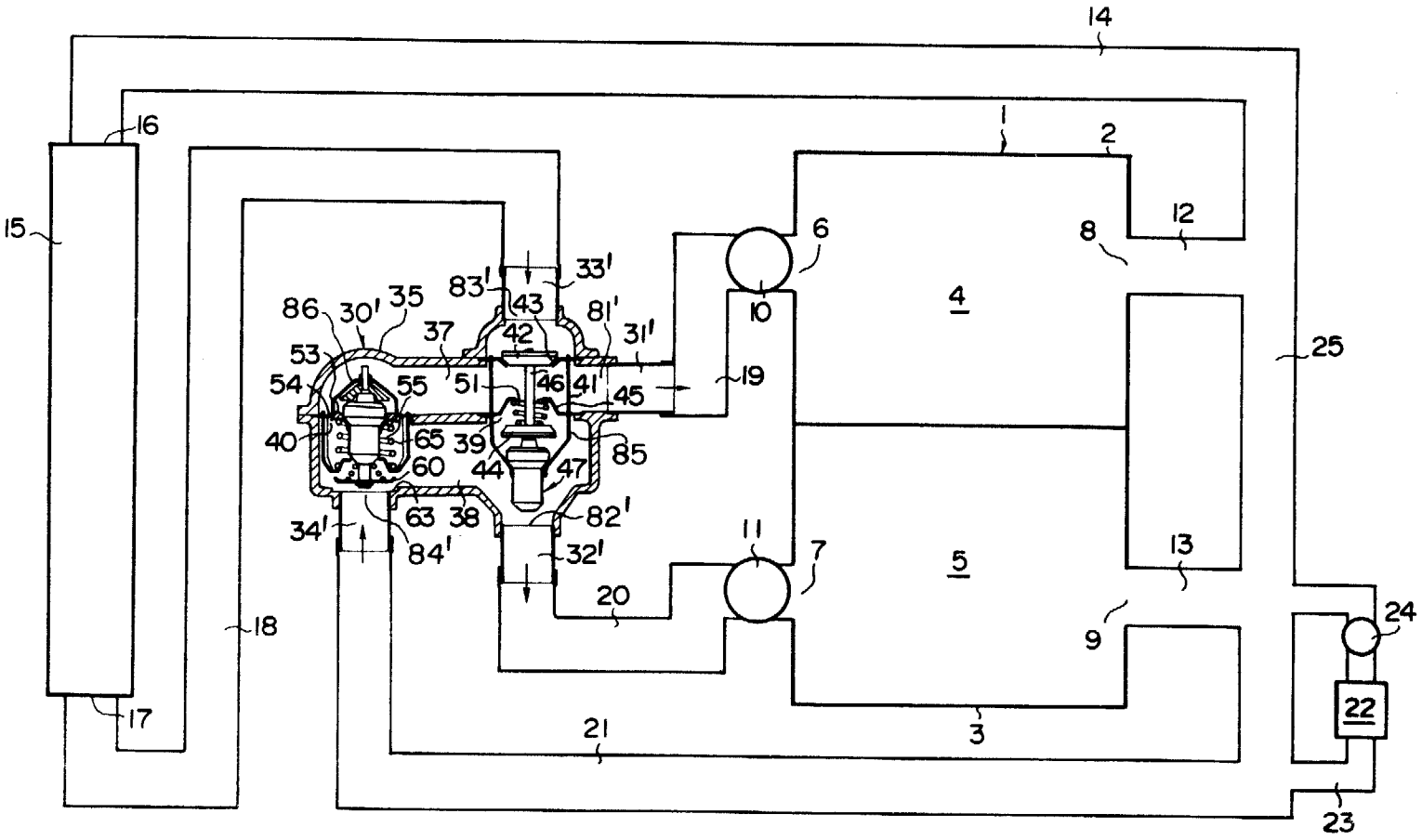
FIG. 6 is a part diagrammatical part cross sectional illustration, similar to FIG. 1, showing diagrammatically the basic parts of a cooling system which is a fifth preferred embodiment of the cooling system according to the present invention, and also showing in sectional form a valve assembly incorporating a pair of temperature sensitive valves which is comprised in this fifth preferred embodiment and which in this fifth preferred embodiment is installed near the inlets of the head and block cooling jackets, so as to control the flows of cooling fluid through these cooling jackets and through a radiator.

In FIG. 6, there is shown a fifth preferred embodiment of the cooling system and valve according to the present invention, in a fashion similar to FIG. 1. In FIG. 6, parts, holes, and chambers of the fifth preferred embodiment shown, which correspond to parts, holes, and chambers of the first through fourth preferred embodiments shown in FIGS. 1 through 5, and which have the same functions, are designated by the same reference numerals and symbols as in those figures.

In this fifth preferred embodiment, the layout of the various cooling passages and of a valve assembly 30' incorporated in said fifth preferred embodiment is quite different from the layout used in the first through fourth preferred embodiments, previously described. In particular, the valve assembly 30', in this fifth preferred embodiment, is provided at the intake sides of the head cooling jacket 4 and of the block cooling jacket 5, rather than at their output sides as was the case with the value assembly 30 in the first through fourth preferred embodiments. However, the actual construction of the valve assembly 30' in this fifth preferred embodiment is exactly the same as the construction of the valve assembly 30 of the first preferred embodiment shown in FIG. 1, although the connections to the ports of this valve assembly 30' of the fifth preferred embodiment, as will be seen later, are quite different from the connections in the previously shown four embodiments.

In FIG. 6, the reference numeral 1 denotes the internal combustion engine, which comprises a cylinder head 2 and a cylinder block 3 which are clamped together, optionally with the invention therebetween of a cylinder head gasket which is not shown. The internal combustion engine 1 includes at least one combustion chamber, which is also not shown, and the cylinder head 2 defines the upper part of this combustion chamber, i.e. the part thereof in which the compression and the ignition occurs, and the surface of which upper part therefore receives the greater proportion of the heat generated in said combustion chamber. The cylinder head 2 is formed with a head cooling jacket 4 which extends close to a large part of said upper part of said combustion chamber, so as, when said head cooling jacket 4 is filled with cooling fluid such as water, to cool said upper part of said combustion chamber, and so as to cool said cylinder head 2. Typically, the internal combustion engine 1 will in fact include several such combustion chambers, and the head cooling jacket 4 will extend past the upper parts of each of these combustion chambers. Cooling fluid is supplied into the head cooling jacket 4 through a cylinder head inlet 6, and is taken out from the head cooling jacket 4 through a cylinder head outlet 8.

Similarly, the cylinder block 3 is formed with a block cooling jacket 5 which extends close to a large part of the side wall defining surface of said combustion chamber, so as, when said block cooling jacket 5 is filled with cooling fluid such as water, to cool said side wall part of said combustion chamber, and so as to cool said cylinder block 3. Again, of course, typically the cylinder block 3 will in fact define several such combustion chamber walls or bores, and the block cooling jacket 5 will extend past the side walls of each of these bores. Cooling fluid is supplied into the block cooling jacket 5 through a cylinder block inlet 7, and is taken out of the block cooling jacket 5 through a cylinder block outlet 9. Further, a cooling radiator 15 of a conventional sort, formed with an inlet 16 positioned at an upper portion thereof and an outlet 17 positioned at a lower portion thereof, is provided for the internal combustion engine 1.

As has been previously explained, during operation of the internal combustion engine 1, the major portion of the heat generated in the combustion chambers thereof is communicated to the cylinder head 2, and only a minor portion of the heat generated in the combustion chambers is communicated directly to the cylinder block 3 of said internal combustion engine 1. Therefore, an imbalance of heating occurs betwen the cylinder head 2 and the cylinder block 3, and a fifth preferred embodiment of the cooling system and valve according to the present invention for cooling the internal combustion engine 1, which corrects said imbalance, will now be explained.

A cylinder head pump 10 is provided proximate to the cylinder head inlet 6, for impelling cooling fluid through the head cooling jacket 4 from the cylinder head inlet 6 to the cylinder head outlet 8; and, similarly, a cylinder block pump 11 is provided, proximate to the cylinder block inlet 7, for impelling cooling fluid through the block cooling jacket 5 from the cylinder block inlet 7 to the cylinder block outlet 9. Cooling fluid is provided to the intake side of the cylinder head pump 10 from the downstream end of a head input conduit 19, and similarly cooling fluid is provided to the intake side of the cylinder block pump 11 from the downstream end of a block input conduit 10. To the cylinder head outlet 8 there is connected the upstream end of a head output conduit 12, and to the cylinder block outlet 9 there is connected the upstream end of a block output conduit 13.

The downstream ends, i.e. the ends remote from the internal combustion engine 1, of the head output conduit 12 and of the block output conduit 13 are connected to the upstream end of a main recirculation conduit 14 and also to the upstream end of a block recirculation conduit 21. The downstream end of said main recirculation conduit 14 is connected to the inlet 16 of the radiator 15, and the outlet 17 of the radiator 15 is connected to the upstream end of a radiator output conduit 18. To an upstream part of the block recirculation conduit 21 there is connected the upstream end of a heater feed conduit 23, at an intermediate point of which there is provided a heater flow regulation valve 24, which selectively can regulate the flow rate of cooling fluid through said heater feed conduit 23; downstream of the heater flow regulation valve 24 in the heater feed conduit 23 there is provided a heater 22; and the downstream end of the heater feed conduit 23 is connected to an intermediate point of the block recirculation conduit 21. Thus the heater 22 can be fed, via the heater feed conduit 23, with part of the cooling fluid flow which is available in the block recirculation conduit 21, in a selective manner under the control of the heater flow regulation valve 24.

The upstream end of the head input conduit 19 is connected to the downstream end of a first union pipe 31', the upstream end of which is connected to a first outlet port 81' of a valve assembly 30' which will be explained in detail later. The upstream end of the block input conduit 20 is connected to the downstream end of a second union pipe 32', the upstream end of which is connected to a second outlet port 82' of said valve assembly 30'. The downstream end of the radiator output conduit 18 is connected to the upstream end of a third union pipe 33', the downstream end of which is connected to a first inlet port 83' of said valve assembly 30'. Finally, the downstream end of the block recirculation conduit 21 is connected to the upstream end of a fourth union pipe 34', the downstream end of which is connected to a second inlet port 84' of said valve assembly 30'.

As will be seen hereinafter, the block recirculation conduit 21, via the valve assembly 30', can communicate the cylinder block outlet 9 to the cylinder block inlet 7 via the cylinder block pump 11 and possibly also the cylinder head outlet 8 to the cylinder head inlet 6 via the cylinder head pump 10, bypassing the radiator 15; and the main recirculation conduit 21, again via said valve assembly 30', can communicate the cylinder head outlet 8 to the cylinder head inlet 6 via the cylinder head pump 10 and possibly also the cylinder block outlet 9 to the cylinder block inlet 7 via the cylinder block pump 11, through the radiator 15.

The particular construction and the per se operation of the valve assembly 30' used in this fifth preferred embodiment of the cooling system and valve according to the present invention will not be explained in detail, since as explained above said construction and per se operation are exactly the same as the construction and per se operation of the valve assembly 30 of the first embodiment shown in FIGS. 1 and 2, although the connections to the ports of this valve assembly 30' of the fifth preferred embodiment are different in that: what was the first inlet port 81 in the valve assembly 30 of the first preferred embodiment has become the first outlet port 81' in the valve assembly 30' of this fifth preferred embodiment; what was the second inlet port 82 in the valve assembly 30 of the first preferred embodiment has become the second outlet port 82' in the valve assembly 30' of this fifth preferred embodiment; what was the first outlet port 83 in the valve assembly 30 of the first preferred embodiment has become the first inlet port 83' in the valve assembly 30' of this fifth preferred embodiment; and what was the second outlet port 84 in the valve assembly 30 of the first preferred embodiment has become the second inlet port 84' in the valve assembly 30' of this fifth preferred embodiment. In fact, any of the valve assemblies according to the second, third, or fourth preferred embodiments of the valve according to the present invention shown in FIGS. 3, 4, or 5 respectively could also be used in a cooling system such as this fifth preferred embodiment of the cooling system according to the present invention, instead of the shown valve assembly 30' which follows the construction of the valve assembly 30' of the first preferred embodiment shown in FIGS. 1 and 2.

THE OPERATION OF THE FIFTH PREFERRED EMBODIMENT

Now, the operation of the fifth preferred embodiment of the cooling system and valve according to the pesent invention described above will be explained.

First, if the cooling fluid passing along the block recirculation conduit 21 and as will be seen later entering the lower chamber 38 of the valve assembly 30' so as to fill it is at a temperature less than the first predetermined temperature value, which has been taken exemplarily as 80° C., then it is considered, according to the operation of this fifth preferred embodiment of the cooling system and valve according to the present invention, that the internal combustion engine 1 is being warmed up from the cold condition. At this time, the valve assembly 30' is in the state shown in FIG. 6.

That is to say, the temperature of the mass of thermally expansible material in the first control valve 85 is of course also below said predetermined first temperature of 80° C., and at this time said mass of thermally expansible material is in a solid state and does not exert significant pressure on the lower end of the valve shaft 46, and therefore the valve shaft 46 and the first valve element 42 and the second valve element 44 which are attached thereto are positioned, by the biasing action of the compression coil spring 51, to their lower positions in which they are shown in FIG. 6, in which the first valve element 42 is seated against the first valve seat 43 and closes the circular hole therethrough thus breaking communication between the upper chamber 37 and the first inlet port 83', i.e. blocking said first inlet port 83', and in which the second valve element 44 is moved away from the second valve seat 45 and opens the circular hole therethrough thus establishing communication between the upper chamber 37 and the lower chamber 38, i.e. opening the first communication port 39. Thus, the first outlet port 81' is put out of communication from the first inlet port 83', but is communicated with the lower chamber 38.

Further, the temperature of the cooling fluid within the lower chamber 38 is of course a fortiori below said predetermined second value, which has been taken exemplarily as 95° C., and thus the temperature of the mass of thermally expansible material in the second control valve 86 is also of course below said predetermined second temperature, and at this time said mass of thermally expansible material is in a solid state and does not exert significant pressure on the lower end of the valve needle (not particularly shown in FIG. 6) of that second control valve 86, and therefore the outer shell of the temperature sensitive valve actuator 55, the first valve element 53, the valve shaft, and the second valve element 60 are positioned, by the biasing action of the compression coil spring 65, to their upper positions in which they are shown in FIG. 6, in which the first valve element 53 is seated against the first valve seat 54 and closes the circular hole therethrough thus breaking communication between the upper chamber 37 and the lower chamber 38, i.e. blocking the second communication port 40, and in which the second valve element 60 is moved away from the second valve seat 63 and opens the circular hole therethrough, thus establishing communication between the lower chamber 38 and the second inlet port 84', i.e. opening said second inlet port 84'. Thus, the second inlet port 84' is communicated with the lower chamber 38.

Accordingly, in this operational state, since the first inlet port 83' is kept completely closed, no fluid flow can occur at this time through the main recirculation conduit 14, the radiator 15, and the radiator output conduit 18. Therefore, the flow of cooling fluid from the cylinder head outlet 8 passes out through the head output conduit 12 and enters into the upstream end of the block recirculation conduit 21 connected thereto, and also the flow of cooling fluid from the cylinder block outlet 9 passes out through the block output conduit 13 and enters into said upstream end of said block recirculation conduit 21 connected thereto. These two flows then flow along the block recirculation conduit 21, mixing therein with one another, and then flow into the lower chamber 38 of the valve assembly 30' through the second inlet port 84' which as mentioned above is opened at this time, this mixed cooling fluid flow not having been significantly cooled because it has not passed through the radiator 15. Part of this combined or mixed cooling fluid flow then enters from said lower chamber 38 into the upper chamber 37 of the valve assembly 30' through the first communication port 39, which as mentioned above is opened at this time, and from this upper chamber 37 said flow then passes out through the first outlet port 81' and is supplied to the inlet side of the cylinder head pump 10 via the head input conduit 19. The cylinder head pump 10 then pumps this cooling fluid back into the head cooling jacket 4 of the cylinder head 2. On the other hand, the rest of this combined or mixed cooling fluid flow from the block recirculation conduit 21 passes directly out from said lower chamber 38 of said valve assembly 30' through the second outlet port 82' and is supplied to the inlet side of the cylinder block pump 11 via the block input conduit 20. The cylinder block pump 11 then pumps this cooling fluid back into the block cooling jacket 5 of the cylinder block 2.

Of course, at this time, no substantial cooling action at all is provided in this mode of operation by the cooling system and valve according to the shown fifth preferred embodiment of the present invention to the internal combustion engine 1 as a whole, because the radiator 15 is at this time receiving no substantial flow of cooling fluid; and the operation of said fifth preferred embodiment of the cooling system and valve according to the present invention is only to redistribute heat which is being produced by combustion within the combustion chamber or chambers of the internal combustion engine 1 from the cylinder head 2 thereof, which as mentioned above directly receives most of the generated heat, to the cylinder block 3 thereof which directly receives only a minor part of the generated heat.

As a result of the above described mode of operation, the warming up characteristic of the cylinder block 3 is much improved, as compared with the conventional case in which the cooling system for the cylinder head 2 is entirely separated from the cooling system for the cylinder block 3. Since it is desirable to raise the temperature of the cylinder block 3 fairly quickly from the cold condition, in order to minimize frictional losses during the warming up process of the internal combustion engine by heating up the lubricating oil contained within it as quickly as possible, and also in order to minimize fuel utilization during engine warmup, and in order to minimize engine wear, especially cylinder bore wear, before the engine block is fairly hot, as explained above, as well as to minimize the emission of noxious components in the exhaust gases of the engine when it is being operated in the cold condition, the above described construction according to the fifth preferred embodiment of the cooling system and valve according to the present invention is very advantageous.

Further, the time for the cooling fluid which passes through the heater 22 to become hot and for the heater 22 to provide heating for the passenger compartment (not shown) of the vehicle to which the internal combustion engine 1 is fitted, if the heater flow regulation valve 24 is opened and flow of cooling fluid is occurring in the heater feed conduit 23, is the same in the case of this fifth preferred embodiment of the present invention as it is in the case of a conventional cooling system in which the cylinder head and the cylinder block are cooled together by one cooling fluid flow conduit, and is substantially less than in the case of a cooling system such as the above detailed prior art in which the cylinder head is cooled completely separately from the cylinder block.

On the other hand, if the cooling fluid passing along the block recirculation conduit 21 is at a temperature higher than the first predetermined temperature value, which has been taken exemplarily as 80° C., then it is considered, according to the operation of this fifth preferred embodiment of the cooling system and valve according to the present invention, that the internal combustion engine 1 is fully warmed up from the cold condition. Suppose further for the time being that said cooling fluid passing along the block recirculation conduit 21 is at a temperature lower than the second predetermined temperature value, which has been taken exemplarily as 95° C. At this time, the valve assembly 30' is in the state which will now be described.

The temperature of the mass of thermally expansible material in the first control valve 85 is of course at this time also above said predetermined first temperature of 80° C., and thus at this time said mass of thermally expansible material is melted and is in the liquid state and has expanded very substantially as compared to its solid state, thus coming to exert significant pressure on the lower end of the valve shaft 46, and therefore the valve shaft 46 and the first valve element 42 and the second valve element 44 which are attached thereto are now positioned, against the biasing action of the compression coil spring 51 which is overcome, to their upper positions in the sense of FIG. 6, in which the first valve element 42 is moved away from the first valve seat 43 and opens the circular hole therethrough thus establishing communication between the upper chamber 37 and the first inlet port 83', i.e. opening said first inlet port 83', and in which the second valve element 44 is seated against the second valve seat 45 and closes the circular hole therethrough thus breaking communication between the upper chamber 37 and the lower chamber 38, i.e. blocking the first communication port 39.

Further, since the temperature of the cooling fluid within the lower chamber 38 is as presently assumed below said predetermined second temperature which has been taken exemplarily as 95° C., therefore the temperature of the mass of thermally expansible material in the second control valve 86 is of course also below said second predetermined temperature of 95° C., and thus at this time said mass of thermally expansible material is in a solid state and does not exert significant pressure on the lower end of the valve needle (not particularly shown in the figures) of this second control valve 86, and therefore the outer shell of the temperature sensitive valve actuator 55, the first valve element 53, the valve shaft, and the second valve element 60 attached thereto are still positioned, as before, by the biasing action of the compression coil spring 65 to their upper positions in which they are shown in FIG. 6, in which the first valve element 53 is seated against the first valve seat 54 and closes the circular hole therethrough thus breaking communication between the upper chamber 37 and the lower chamber 38, i.e. blocking the second communication port 40, and in which the second valve element 60 is moved away from the second valve seat 63 and opens the circular hole therethrough thus establishing communication between the lower chamber 38 and the second inlet port 84', i.e. opening said second inlet port 84'.

Accordingly, in this operational state, since the first communication port 39 and also the second communication port 40 are both kept completely closed, no substantial mixing can occur between the flow of cooling fluid that is passing out of the cylinder head cooling jacket 4 through the cylinder head outlet 8, which passes down the main recirculation conduit 14 through the radiator 15 in which it is cooled, and thence passes via the radiator output conduit 18 into the upper chamber 37 of the valve assembly 30' in through the first inlet port 83', and the flow of cooling fluid that is passing out of the cylinder block cooling jacket 5 through the cylinder block outlet 9, which passes along the block recirculation conduit 21 so as to pass into the lower chamber 38 of the valve assembly 30' through the second inlet port 84', not being substantially cooled en route.

Thus, the first above described flow of cooling fluid which has passed through the head cooling jacket 4 and has been heated therein and has passed through the radiator 15 and has been cooled therein flows out from the upper chamber 37 of the valve assembly 30' through the first outlet port 81', whence it passes into the upstream end of the head input conduit 19. Then, this cooling fluid flow passes down through the head input conduit 19 so as to be supplied to the inlet of the cylinder head pump 10, whichh pumps it into the cylinder head inlet 6, whence said cooling fluid flow is returned to the head cooling jacket 4.

On the other hand, the second above described flow of cooling fluid which has passed through the block cooling jacket 5 and has been heated therein and has flowed down the block recirculation conduit 21 without being substantially cooled while passing therealong flows out from the lower chamber 38 of the valve assembly 30' through the second outlet port 82', whence it passes into the upstream end of the block input conduit 20. Then, this cooling fluid flow passes down through the block input conduit 20 so as to be supplied to the inlet of the cylinder block pump 11, which pumps it into the cylinder block inlet 7, whence said cooling fluid flow is returned to the block cooling jacket 5.

Of course, at this time substantially no cooling action at all is provided in this mode of operation by the cooling system and valve according to this fifth preferred embodiment of the present invention to the cylinder block 3, because said cylinder block 3 is receiving no flow of cooling fluid which has passed through the radiator 15; and the operation of the shown fifth preferred embodiment of the cooling system and valve according to the present invention is only to cool the cylinder head 2 of the internal combustion engine 1, which directly receives most of the heat generated by combustion in the combustion chamber or chambers thereof by using the maximum cooling capacity of the radiator 15, but not to cool the cylinder block 3 which directly receives only a minor part of the generated heat.

Suppose now, on the other hand, that said cooling fluid passing along the block recirculation conduit 21 (which has been heated only in the cylinder block 3 and not in the cylinder head 2, and which has not been substantially cooled) comes to be at a higher temperature than the second predetermined temperature value which has been taken exemplarily as 95° C. At this time, the valve assembly 30' transits to the state which will now be described.

The temperature of the mass of thermally expansible material in the first control valve 85 of course remains above the first predetermined temperature of exemplarily 80° C., and thus at this time said mass of thermally expansible material remains melted and in the liquid state as expanded very substantially as compared to its solid state, thus continuing to exert significant pressure on the lower end of the valve shaft 46, and therefore the valve shaft 46 and the first valve element 42 and the second valve element 44 which are attached to said valve shaft 46 remain positioned, against the biasing action of the compression coil spring 51 which is overcome, to their upper positions in the sense of FIG. 6 as previously described, in which the first valve element 42 is moved away from the first valve seat 43 and opens the circular hole therethrough thus establishing communication between the upper chamber 37 and the first inlet port 83', i.e. opening said first inlet port 83', and in which the second valve element 44 is seated against the second valve seat 45 and closes the circular hole therethrough thus breaking communication between the upper chamber 37 and the lower chamber 38, i.e. blocking the first communication port 39.

However, since the temperature of the cooling fluid within the lower chamber 38 now has come to be above said predetermined second temperature which has exemplarily been taken as 95° C., therefore the temperature of the mass of thermally expansible material in the second control valve 86 is of course also now above said predetermined second temperature of 95° C., and thus at this time said mass of thermally expansible material has melted and has come to be in the liquid state and has expanded very substantially, and thus has come to exert significant pressure on the lower end of the valve needle (not shown) of the second control valve 86, and therefore the outer shell of the temperature sensitive valve actuator 55, the first valve element 53, the valve shaft, and the second valve element 60 are now positioned, against the biasing action of the compression coil spring 65 which is now overcome, to their lower positions in the sense of FIG. 6, in which the first valve element 53 is moved away from the first valve seat 54 and opens the circular hole therethrough thus establishing communication between the upper chamber 37 and the lower chamber 38, i.e. opening the second communication port 40, and in which the second valve element 60 is seated against the second valve seat 63 and closes the circular hole therethrough, thus breaking communication between the upper chamber 37 and the lower chamber 38, i.e. closing said second inlet port 84'. In this operational state, since the second inlet port 84' is now completely closed, no substantial flow of cooling fluid can take place through the block recirculation conduit 21. However, as will be explained in some detail later, actually in practical operation of the cooling system and valve according to this fifth preferred embodiment of the present invention this operational state described above is never completely and properly maintained to its full extent for any substantial length of time, due to an oscillation effect of the action of the second control valve 86. However, herein the description of this operational state will be made under the assumption that it is being completely and properly maintained by the shown cooling system and valve according to the fifth preferred embodiment of the present invention.

Thus, the flow of cooling fluid which has passed through the block cooling jacket 5 and has been heated therein flows out from the cylinder block outlet 9 and enters into the upstream end of the main recirculation conduit 14, in which it mixes with the flow of cooling fluid which has passed through the head cooling jacket 4 and has been heated therein and has flowed out of the cylinder head outlet 8 and has also entered into the upstream end of said main recirculation conduit 14. These two mixed flows then pass down along said main recirculation conduit 14, then enter into the inlet 16 of the radiator 15, and are then cooled within said radiator 15 in a per se well known fashion. Then these mixed flows pass out of the outlet 17 of the radiator 15 into the upstream end of the radiator output conduit 18, along which they flow, and from the downstream end of which they pass through the first inlet port 83' of the valve assembly 30', which as mentioned above is open at this time, to enter into the upper chamber 37 of said valve assembly 30'. Part of this combined and mixed flow of cooling fluid then enters from said upper chamber 37 via the first outlet port 81' into the upstream end of the head input conduit 19 so as to be supplied to the inlet of the cylinder head pump 10, which pumps said cooling fluid flow into the cylinder head inlet 6, whence it is returned to the head cooling jacket 4; and also a part of this mixed cooling fluid flow passes from said upper chamber 37 through the second communication port 40 which as mentioned above is open at this time to enter into the lower chamber 38 of the valve assembly 30', whence via the second outlet port 82' it passes into the upstream end of the block input conduit 20 so as to be supplied to the inlet of the cylinder block pump 11, which pumps said cooling fluid flow into the cylinder block inlet 7, whence it is returned to the block cooling jacket 5.

Of course, all this time, cooling action is provided in this mode of operation by the cooling system and valve according to the shown fifth preferred embodiment of the present invention both to the cylinder head 2 of the internal combustion engine 1 and also to the cylinder block 3 thereof, because both the cylinder head 2 and also the cylinder block 3 are receiving flow of cooling fluid which has passed through the radiator 15; and the function in this operational mode of the shown fifth preferred embodiment of the cooling system and valve according to the present invention is not only to cool the cylinder head 2 of the internal combustion engine 1 which directly receives most of the heat generated by combustion in the combustion chamber or chambers thereof, but also to cool the cylinder block 3 which directly receives only a minor part of the generated heat, but which is in fact somewhat overheated at this time.

It should be noted that, in this ideal or theoretical operational condition, because no substantial flow of cooling fluid is passing down the block recirculation conduit 21, therefore theoretically no flow of cooling fluid can occur through the heater feed conduit 23 and through the heater 22, and therefore theoretically speaking the heater 22 should become inoperative. However, because as suggested above and as will be explained in some detail later in fact this operational condition in which the second inlet port 84' of the valve assembly 30' is completely closed in fact is never maintained for a substantially long time, but rather the shown fifth preferred embodiment of the cooling system and valve according to the present invention in fact oscillates between the above described operational condition and its previously described operational condition in which the second inlet port 84' of the valve assembly 30' is opened (at least partially) while the second communication port 40 is closed (at least partially), therefore no problem with regard to the operation of the heater 22 in practice arises.

As a result of the above explained modes of operation, when the temperature of the cooling fluid within the lower chamber 38 of the valve assembly 30' which has flowed through the block cooling jacket 5 to cool it and has been heated therein and has flowed out from the cylinder block outlet 9 down the block recirculation conduit 21 without being substantially cooled and has flowed in through the second inlet port 84' into said lower chamber 38 comes to be above said predetermined second temperature which has been exemplarily taken as 95° C. from being below said predetermined second temperature, immediately the state of the second control valve 86 alters due to the melting of its mass of thermally expansible material, and the second inlet port 84' which was open before is closed while the second communication port 40 which was closed before is opened; and thereby the cooling system, from its operational mode in which the cylinder head 2 alone was cooled by using the maximum cooling capacity of the radiator 15 while the cylinder block 3 was not cooled at all, transits to its operational mode in which the cylinder head 2 and the cylinder block 3 are cooled together by the cooling fluid flows which pass through them being mixed before both passing through the radiator 15 to be cooled therein.

Thus, in this case, soon the tempertaure of the cooling fluid which has flowed through the block cooling jacket 5 to cool it and has been heated therein and has flowed out from the cylinder block outlet 9 down the block recirculation conduit 21 and through the second inlet port 84' into said lower chamber 38 drops and comes to be below said predetermined second temperature (exemplarily 95°) from being above said predetermined second temperature, and then immediately the state of the second control valve 86 again alters due to the solidifying of its said mass of thermally expansible material, and the second inlet port 84' which was closed before is opened while the second communication port 40 which was opened before is closed; and thereby the cooling system, from its operational mode in which the cylinder head 2 and the cylinder block 3 were cooled together by the cooling fluid flows which passed through them being mixed before passing through the radiator 15 to be both cooled therein transits back to its operational mode in which the cylinder head 2 alone is cooled by using the maximum cooling capacity of the radiator 15 while the cylinder block 3 is not cooled at all. Thus, in this case, soon the temperature of the cooling fluid which has flowed through the block cooling jacket 5 to cool it and has been heated therein and has flowed out from the cylinder block outlet 9 down the block recirculation conduit 21 through the second inlet port 84' into said lower chamber 38 again rises and comes to be above said predetermined second temperature from being below said predetermined second temperature.

By a repetition of this to and fro action of the second control valve 86, therefore, the temperature of the cooling fluid which has flowed through the block cooling jacket 5 to cool it and has been heated therein and has flowed out from the cylinder block outlet 9 down the block recirculation conduit 21 and through the second inlet port 84' into said lower chamber 38 is kept quite near the second predetermined temperature of exemplarily 95° C., by said block cooling fluid flow being alternatively passed through the block recirculation conduit 21 to be recirculated to the cylinder block 3 without being substantially cooled, or being mixed with the head cooling fluid flow in the main recirculation conduit 14 and being passed through the radiator 15 to be cooled. Thus the temperature of the cyliner block 3 is regulated to a proper quite high value, substantially higher than the temperature of the cylinder head 2, without being allowed to rise to an excessively high level.

In other words, by the combination of these two actions of the second control valve 86, according as to whether the temperature of the cooling fluid flowing out of the cylinder block outlet 9 of the block cooling jacket 5 is less than said second predetermined temperature value of exemplarily 95° C., or alternatively is greater than said second predetermined temperature value, therefore, in a feedback manner, the temperature of the cooling fluid passing out through the cylinder block outlet 9 of the block cooling jacket 5 is maintained substantially to be at the second above described predetermined temperature of 95° C. This means that the temperature of the cylinder block 3 as a whole is maintained substantially at a temperature value somewhat above, but not too much above, said second predetermined temperature value, i.e. in the shown fifth preferred embodiment is maintained at a temperature somewhat above 95° C., which is of course substantially higher than the temperature at which the cylinder head 2 is being maintained at this time, since the cooling fluid which is circulating through the head cooling jacket 4 is entirely, as described above, cooling fluid which has passed through the radiator 15 to be cooled, and is accordingly quite cool.

With regard particularly to the operation of this fifth preferred embodiment of the cooling system and valve according to the present invention, this to and fro action of the second control valve 86 for regulating the temperature of the cylinder block 3 is in fact finer and more stable than the to and fro action of any one of the first through fourth embodiments shown in FIGS. 1 through 5 and described above, because actually as soon as the second control valve 86 starts to transit from its first above described operational condition in which the cylinder head 2 alone is cooled by using the maximum cooling capacity of the radiator 15 while the cylinder block 3 is not cooled at all, to its operational condition in which the cylinder head 2 and the cylinder block 3 are cooled together by the cooling fluid flows which passes through them being mixed before passing through the radiator 15 to be both cooled therein, then as soon as the second communication port 40 opens even partially a quantity of cooling fluid which is within the upper chamber 37 and which is at a temperature substantially lower than the second predetermined temperature value (exemplarily 95° C.) passes through this second communication port 40 and impinges on the outer casing of the temperature sensitive actuator 55 of the second control valve 86, and when this happens this will tend to cause the second control valve 86 to transit back towards its first above described operational condition in which the cylinder head 2 alone is cooled by using the maximum cooling capacity of the radiator 15 while the cylinder block 3 is not cooled at all; but of course it cannot completely transit to this first operational condition, due to the high temperature of the cooling fluid which is passing down the block recirculation conduit 21 to enter the valve assembly 30' through the second inlet port 84' thereof. In other words, an oscillating balance is struck in the operation of this second control valve 86, in which a proportion of the cooling fluid which passes through the block cooling jacket 5 is recirculated down the main recirculation conduit and passes through the radiator 15 to be cooled, while the rest of said cooling fluid which passes through the block cooling jacket 5 is recirculated down the block recirculation conduit 21, to not be substantially cooled; and this oscillating balance is so reached as to keep the temperature of said cooling fluid which is passing through the block cooling jacket 5 at approximately the second predetermined temperature of exemplarily 95° C. In fact, this balance, in this fifth preferred embodiment of the cooling system and valve according to the present invention, has been determined in practice to be more stable and more accurate than the balance described with respect to the first preferred embodiment shown in FIG. 1.

Accordingly, by thus keeping the cylinder head 2 substantially cooler than the cylinder block 3 during warmed up operation of the internal combustion engine 1, the cylinder block 3 may be kept significantly hotter than is possible with a conventional cooling system in which the head cooling fluid and the block cooling fluid are both always being passed through the same radiator and are being cooled together. Further, the temperature of the lubricating oil contained within the internal combustion engine 1 is at this time kept at at least the temperature of the cylinder block 3, and in fact is maintained at a significantly higher temperature, due to the dissipation of mechanical energy therein. Of course, by keeping the cylinder head 2 as cool as possible, and by using as much of the capacity of the radiator 15 as possible for cooling the cylinder head 2, the possibility of the occurrence of knocking or pinking in the internal combustion engine 1 is greatly reduced. The keeping of the cylinder block 3 as hot as possible within a predetermined temperature limit, i.e. substantially at the second predetermined temperature value of exemplarily 95° C., ensures that frictional losses in the internal combustion engine 1 are kept as low as possible, and also is beneficial with regard to the minimization of the amount of noxious components which are emitted in the exhaust gases of the internal combustion engine 1.

Further, in contrast to a conventional type of cooling system as previously discussed above in which completely separate cooling systems are used for the cylinder head and for the cylinder block, the full capacity of the radiator 15 can be effectively utilized according to the fifth preferred embodiment of the cooling system and valve according to the present invention as described above, because of the flexibility available for determining the proportions of the cooling capacity of the radiator which can be allocated to the cylinder head 2 and to the cylinder block 3 for cooling them.

Thus it is seen that, in this fifth preferred embodiment of the cooling system and valve according to the present invention also, in which the position of the valve assembly 30' is substantially reversed as compared with the other four preferred embodiments shown, the various advantages and benefits of the present invention are available. The occurrence of knocking in the cylinders of the internal combustion engine 1 is guarded against by keeping the cylinder head 2 as cool as possible, and at the same time the cylinder block 3 is kept warmer than in the type of prior art in which the block cooling fluid flow and the head cooling fluid flow are mixed at all times. Further, the warming up time for the internal combustion engine 1 is kept minimal, and hence wear thereof during warming up, and consumption of fuel during this warm up period, are minimized.

Further, with regard to the matter of the heater 21 fitted in the passenger compartment of a vehicle to which the internal combustion engine 1 incorporating the cooling system and valve according to this fifth embodiment of the present invention are fitted, when this heater 21 is fitted as is shown in FIGS. 1 and 6 so as either to use heated cooling fluid taken from an intermediate portion of the block output conduit 13 or to use heated cooling fluid diverted via the conduit 23 from an intermediate part of the block recirculation conduit 21, in other words so as to use only cooling fluid from the cylinder block 3 for heating the heater core, rather than cooling fluid from the cylinder head 2 or a mixture of cooling fluid from the cylinder block 3 and the cylinder head 2, then a better heating effect is made available. This is because the cooling fluid of the cylinder block 3 is, as explained above, kept by the cooling system and valve according to the present invention generally hotter than is the cooling fluid of the cylinder head 2.

Although the present invention has been shown and described with reference to several preferred embodiments thereof, and in terms of the illustrative drawings, it should not be considered as limited thereby. Various possible modifications, omissions, and alterations could be conceived of by one skilled in the art to the form and the content of any particular embodiment, without departing from the scope of the present invention. Therefore it is desired that the scope of the present invention, and of the protection sought to be granted by Letters Patent, should be defined not by any of the perhaps purely fortuitous details of the shown embodiments, or of the drawings, but solely by the scope of the appended claims, which follow.

What is claimed is:

1. For an internal combustion engine comprising:

(a) a cylinder head formed with a head cooling jacket for cooling said cylinder head, said head cooling jacket being formed with a cylinder head inlet and a cylinder head outlet;

(b) a cylinder block formed with a block cooling jacket for cooling said cylinder block, said block cooling jacket being formed with a cylinder block inlet and a cylinder block outlet; and (c) a radiator formed with an inlet and an outlet;

a cooling system, comprising:

(d) a first pump for impelling cooling fluid through said head cooling jacket from said cylinder head inlet towards said cylinder head outlet;

(e) a second pump for impelling cooling fluid through said block cooling jacket from said cylinder block inlet towards said cylinder block outlet;

(f) a block recirculation conduit system leading from said cylinder block outlet of said block cooling jacket so as to supply flow of cooling fluid, from a downstream part of said block recirculation conduit system, to said cylinder block inlet of said block cooling jacket;

(g) a main recirculation conduit system, an upstream part of which is communicated to said cylinder head outlet of said head cooling jacket, and a downstream part of which is communicated to said inlet of said radiator;

(h) a radiator output conduit system, leading from said outlet of said radiator to said cylinder head inlet of said head cooling jacket;

(i) a first junction assembly between said block recirculation conduit system and said main recirculation conduit system at upstream parts thereof, which at least sometimes allows flow between said part of said block recirculation conduit system and said part of said main recirculation conduit system;

(j) a second junction assembly between a downstream part of said block recirculation conduit system and a part of said radiator output conduit system, which at least sometimes allows flow between said part of said block recirculation conduit system and said part of said radiator output conduit system;

(k) and a mechanical non-electrical control valve assembly which is incorporated in one of said first junction assembly and said second junction assembly and which controls the allocation of flow through said head cooling jacket and flow through said block cooling jacket between said block recirculation conduit system and said main recirculation conduit system, according to a set of parameters which include the temperature of the cooling fluid passing out of said block cooling jacket;

said control valve assembly: when it detects a temperature of the cooling fluid flow passing out of said block cooling jacket of less than a first predetermined temperature, being so switched that it directs substantially all the cooling fluid flow through said head cooling jacket which is passing out through said cylinder head outlet and also substantially all the cooling fluid flow through said block cooling jacket which is passing out through said cylinder block outlet to flow into said upstream part of said block recirculation conduit system, said two cooling fluid flows being mixed within said block recirculation conduit system, not directing any substantial cooling fluid flow to flow into said upstream part of said main recirculation conduit system; when it detects a temperature of the cooling fluid passing out of said block cooling jacket of greater than said first predetermined temperature but less than a second predetermined temperature greater than said first predetermined temperature, being switched so that it directs substantially all the cooling fluid flow through said head cooling jacket which is passing out through said cylinder head outlet to flow into said upstream part of said main recirculation conduit system and through said radiator, and so that it directs substantially all the cooling fluid flow through said block cooling jacket which is passing out through said cylinder block outlet to flow into said upstream part of said block recirculation conduit system; and, when it detects a temperature of the cooling fluid passing out of said block cooling jacket of greater than said second predetermined temperature, being so switched that it directs substantially all the cooling fluid flow through said head cooling jacket which is passing out through said cylinder head outlet and also substantially all the cooling fluid flow through said block cooling jacket which is passing out through said cylinder block outlet to flow into said upstream part of said main recirculation conduit system and through said radiator, said two cooling fluid flows being mixed within said main recirculation conduit system and within said radiator, not directing any substantial cooling fluid flow into said upstream part of said block recirculation conduit system.

2. A cooling system according to claim 1, wherein said control valve assembly is incorporated in said first junction assembly.

3. A cooling system according to claim 1, wherein said control valve assembly is incorporated in said second junction assembly.

4. A cooling system according to claim 2, wherein said second junction assembly is a simple junction between said part of said block recirculation conduit system and said part of said radiator output conduit system, and allows free flow between said part of said block recirculation conduit system and said part of said radiator output conduit system in both directions.

5. A cooling system according to claim 3, wherein said first junction assembly is a simple junction between said part of said block recirculation conduit system and said part of said radiator output conduit system, and allows free flow between said part of said block recirculation conduit system and said part of said radiator output conduit system in both directions.

6. A cooling system according to claim 2, wherein said control valve assembly: when it detects a temperature of the cooling fluid flow passing out of said block cooling jacket of less than said first predetermined temperature, is so switched that it directs substantially all the cooling fluid flow through said head cooling jacket which is passing out through said cylinder head outlet and also substantially all the cooling fluid flow through said block cooling jacket which is passing out through said cylinder block outlet to flow into said upstream part of said block recirculation conduit system, not directing any substantial cooling fluid flow into said upstream part of said main recirculation conduit system; when it detects a temperature of the cooling fluid passing out of said block cooling jacket of greater than said first predetermined temperature but less than said second predetermined temperature, is switched so that it directs substantially all the cooling fluid flow through said head cooling jacket which is passing out through said cylinder head outlet to flow into said upstream part of said main recirculation conduit system and through said radiator, and so that it directs substantially all the cooling fluid flow through said block cooling jacket which is passing out through said cylinder block outlet to flow into said upstream part of said block recirculation conduit system; and, when it detects a temperature of the cooling fluid passing out of said block cooling jacket of greater than said second predetermined temperature, is so switched that it directs substantially all the cooling fluid flow through said head cooling jacket which is passing out through said cylinder head outlet and also substantially all the cooling fluid flow through said block cooling jacket which is passing out through said cylinder block outlet to flow into said upstream part of said main recirculation conduit system and through said radiator, said two cooling fluid flows being mixed within said main recirculation conduit system and within said radiator, not directing any substantial cooling fluid flow into said upstream part of said block recirculation conduit system; whereby, during the warming up process of said internal combustion engine, before the cooling fluid which passes out through said cylinder block outlet of said block cooling jacket has attained said first predetermined temperature, the cooling systems for said cylinder head and for said cylinder block are substantially communicated, and no substantial cooling is provided for either by said radiator, so that the heat which is supplied to the cooling fluid within the head cooling jacket is communicated to the cooling fluid within the block cooling jacket, and both the cylinder head and the cylinder block are quickly warmed up together; but, after said cooling fluid which passes out through said cylinder block outlet of said block cooling jacket has attained said first predetermined temperature, then substantial cooling is provided for the cooling fluid in said head cooling jacket, while the amount of cooling provided for the cooling fluid in said block cooling jacket is such that said cooling fluid in said block cooling jacket is kept approximately at said second predetermined temperature; whereby, after said internal combustion engine has been warmed up, said cylinder block may be kept substantially warmer than said cylinder head.

7. A cooling system according to claim 3, whrein said control valve assembly: when it detects a temperature of the cooling fluid flow passing out of said block cooling jacket of less than said first predetermined temperature, is so switched that it directs substantially all the cooling fluid flow through said head cooling jacket which is passing in through said cylinder head inlet and also substantially all the cooling fluid flow through said block cooling jacket which is passing in through said cylinder block inlet to flow thereinto from said downstream part of said block recirculation conduit system, not directing any substantial cooling fluid flow thereinto from said upstream part of said main recirculation conduit system; when it detects a temperature of the cooling fluid passing out of said block cooling jacket of greater than said first predetermined temperature but less than said second predetermined temperature, is switched so that it directs substantially all the cooling fluid flow through said head cooling jacket which is passing in through said cylinder head inlet to flow thereinto from said part of said radiator output conduit system and from said radiator, and so that it directs substantially all the cooling fluid flow through said block cooling jacket which is passing in through said cylinder block inlet to flow thereinto from said upstream part of said block recirculation conduit system; and, when it detects a temperature of the cooling fluid passing out of said block cooling jacket of greater than said second predetermined temperature, is so switched that it directs substantially all the cooling fluid flow through said head cooling jacket which is passing in through said cylinder head inlet and also substantially all the cooling fluid flow through said block cooling jacket which is passing in through said cylinder block inlet to flow thereinto from said part of said radiator output conduit system and from said radiator, not directing any substantial cooling fluid flow thereinto from said downstream part of said block recirculation conduit system; whereby, during the warming up process of said internal combustion engine, before the cooling fluid which passes out through said cylinder block outlet of said block cooling jacket has attained said first predetermined temperature, the cooling systems for said cylinder head and for said cylinder block are substantially communicated, and no substantial cooling is provided for either by said radiator, so that the heat which is supplied to the cooling fluid within the head cooling jacket is communicated to the cooling fluid within the block cooling jacket, and both the cylinder head and the cylinder block are quickly warmed up together; but, after said cooling fluid which passes out through said cylinder block outlet of said block cooling jacket has attained said first predetermined temperature, then substantial cooling is provided for the cooling fluid in said head cooling jacket, while the amount of cooling provided for the cooling fluid in said block cooling jacket is such that said cooling fluid in said block cooling jacket is kept approximately at said second predetermined temperature; whereby, after said internal combustion engine has been warmed up, said cylinder block may be kept substantially warmer than said cylinder head.

8. A cooling system according to claim 1, wherein said control valve assembly comprises:

a valve casing formed with a first port, a second port, a third port, and a fourth port;

a first valve element and a first valve seat cooperating with said first valve element so as to open and close a first controlled aperture through said first valve seat, said first controlled aperture being on a first fluid flow path between said first port and said third port and being the only controlled aperture thereon, and also being on a third fluid flow path between said second port and said third port;

a second valve element and a second valve seat cooperating with said second valve element so as to open and close a second controlled aperture through said second valve seat, said second controlled aperture being on a second fluid flow path between said first port and said fourth port;

a third valve element and a third valve seat cooperating with said third valve element so as to open and close a third controlled aperture through said third valve seat, said third controlled aperture being on said third fluid flow path between said second port and said third port, said first and third controlled apertures being the only controlled apertures on said third fluid flow path between said second port and said third port;

a fourth valve element and a fourth valve seat cooperating with said fourth valve element so as to open and close a fourth controlled aperture through said fourth valve seat, said fourth controlled aperture being on a fourth fluid flow path between said second port and said fourth port and being the only controlled aperture thereon, and said fourth controlled aperture also being on said second fluid flow path between said first port and said fourth port, said second and fourth controlled apertures being the only controlled apertures on said second fluid flow path between said first port and said fourth port;

a first temperature sensitive actuator exposed to sense the temperature near said second port or said fourth port, which, when it senses a temperature less than said first predetermined temperature, moves said first valve element so as to press said first valve element against said first valve seat and so as to close said first controlled aperture through said first valve seat, interrupting communication between said first port and said third port via said first fluid flow path and between said second port and said third port via said third fluid flow path, and moves said second valve element so as to bring said second valve element away from said second valve seat and so as to open said second controlled aperture through said second valve seat, partially establishing communication between said first port and said fourth port via said second fluid flow path; and when it senses a temperature higher than said first predetermined temperature, moves said first valve element so as to bring said first valve element away from said first valve seat and so as to open said first controlled aperture through said first valve seat, establishing communication between said first port and said third port via said first fluid flow path and partially establishing communication between said second port and said third port via said third fluid flow path, and moves said second valve element so as to press said second valve element against said second valve seat and so as to close said second controlled aperture through said second valve seat, interrupting communication between said first port and said fourth port via said second fluid flow path;

a second temperature sensitive actuator exposed to sense the temperature near said second port or said fourth port or on the side of said third controlled aperture towards said fourth port, which, when it senses a temperature less than said second predetermined temperature, moves said third valve element so as to press said third valve element against said third valve seat and so as to close said third controlled aperture through said third valve seat, interrupting communication between said second port and said third port via said third flow path, and moves said fourth valve element so as to bring said fourth valve element away from said fourth valve seat and so as to open said fourth controlled aperture through said fourth valve seat, establishing communication between said second port and said fourth port via said fourth fluid flow path and partially establishing communication between said first port and said fourth port via said second fluid flow path; and when it senses a temperature higher than said second predetermined temperature, moves said third valve element so as to bring said third valve element away from said third valve seat and so as to open said third controlled aperture through said third valve seat, partially establishing communication between said second port and said third port via said third fluid flow path, and moves said fourth valve element so as to press said fourth valve element against said fourth valve seat and so as to close said fourth controlled aperture through said fourth valve seat, interrupting communication between said second port and said fourth port via said fourth fluid flow path and interrupting communication between said first port and said fourth port via said second fluid flow path.

9. A cooling system according to claim 8, wherein said control valve assembly is incorporated in said first junction assembly; said first port being an inlet port and being communicated via an upstream portion of said main recirculation conduit system to said cylinder head outlet of said head cooling jacket; said second port being another inlet port and being communicated via an upstream portion of said block recirculation conduit system to said cylinder block outlet of said block cooling jacket; said third port being an outlet port and being communicated via a downstream portion of said main recirculation conduit system to said inlet of said radiator; and said fourth port being another outlet port and being communicated via a downstream portion of said block recirculation conduit system to said second junction assembly.

10. A cooling system according to claim 9, wherein said second junction assembly is a simple junction between said part of said block recirculation conduit system and said part of said radiator output conduit system, and allows free flow between said part of said block recirculation conduit system and said part of said radiator output conduit system in both directions.

11. A cooling system according to claim 8, wherein said control valve assembly is incorporated in said second junction assembly; said first port being an outlet port and being communicated via a downstream portion of said radiator output conduit system to said cylinder head inlet of said head cooling jacket; said second port being another outlet port and being communicated via an downstream portion of said block recirculation conduit system to said cylinder block inlet of said block cooling jacket; said third port being an inlet port and being communicated via an upstream portion of said radiator output conduit system to said outlet of said radiator; and said fourth port being another inlet port and being communicated via an upstream portion of said block recirculation conduit system to said first junction assembly.

12. A cooling system according to claim 11, wherein said first junction assembly is a simple junction between said part of said block recirculation conduit system and said part of said main recirculation conduit system, and allows free flow between said part of said block recirculation conduit system and said part of said main recirculation conduit system in both directions.

13. A cooling system according to any one of claims 8-12, wherein said valve casing defines a first chamber and a second chamber, said first port opening into said first chamber, said second port opening into said second chamber, said first controlled aperture communicating said third port to said first chamber, and said fourth controlled aperture communicating said fourth port to said second chamber; said second controlled aperture and said third controlled aperture opening between said first chamber and said second chamber.

14. A cooling system according to claim 13, wherein said first valve element and said first valve seat, said second valve element and said second valve seat, said third valve element and said third valve seat, and said fourth valve element and said fourth valve seat are all circular; said first valve element, said first valve seat, said second valve element, and said second valve seat all being coaxial with a common first axis, and said third valve element, said third valve seat, said fourth valve element, and said fourth valve seat also all being coaxial with a common second axis; said first valve element and said second valve element moving to and fro along said first axis by the action of said first temperature sensitive actuator so as to open and close said first controlled aperture and said second controlled aperture in cooperation with said first valve seat and said second valve seat, and said third valve element and said fourth valve element moving to and fro along said second axis by the action of said second temperature sensitive actuator so as to open and close said third controlled aperture and said fourth controlled aperture in cooperation with said third valve seat and said fourth valve seat.

15. A cooling system according to claim 14, wherein said valve assembly further comprises a valve shaft extending along said first axis to which said first valve element and said second valve element are fixed, said valve shaft being moved to and fro along said first axis by the action of said first temperature sensitive actuator so as to move said first valve element and said second valve element to and fro along said first axis and so as to open and to close said first controlled aperture and said second controlled aperture.

16. A cooling system according to claim 14, wherein said valve assembly further comprises a valve shaft extending along said first axis on which said first valve element and said second valve element are slidably mounted, said first valve element being biased relative to said valve shaft to a first preferred position thereon, and said second valve element being biased relative to said valve shaft to a second preferred position thereon, said valve shaft being moved to and fro along said first axis by the action of said first temperature sensitive actuator so as to move said first valve element and said second valve element to and fro along said first axis and so as to open and to close said first controlled aperture and said second controlled aperture.

17. A cooling system according to claim 14, wherein said valve assembly further comprises a first valve shaft extending along said first axis on which said first valve element is fixedly mounted and a second valve shaft extending along said first axis and axially opposing said first valve shaft on which said second valve element is slidably mounted, said first valve element and said first valve shaft being biased in the direction of said second valve shaft so as to impel said first valve element toward said first valve seat, and said second valve element being biased relative to said second valve shaft to a preferred position thereon, said second valve shaft being moved to and fro along said first axis by the action of said first temperature sensitive actuator so as to move said second valve element to and fro along said first axis so as to open and to close said second controlled aperture, and so as to impinge axially on the assembly of said first valve shaft and said first valve element so as to impel said first valve element in the direction away from said first valve seat against said biasing which is overcome so as to open said first controlled aperture.

18. A cooling system according to any one of claims 8-12, wherein said valve assembly further comprises a bypass conduit leading from said fourth port to a point within said casing proximate to said second temperature sensitive actuator.

19. A cooling system according to claim 13, wherein said valve assembly further comprises a bypass conduit leading from said fourth port to a point within said second chamber proximate to said second temperature sensitive actuator.

20. A cooling system according to claim 14, wherein said valve assembly further comprises a bypass conduit leading from said fourth port to a point within said second chamber proximate to said second temperature sensitive actuator.

21. A cooling system according to claim 15, wherein said valve assembly further comprises a bypass conduit leading from said fourth port to a point within said second chamber proximate to said second temperature sensitive actuator.

22. A cooling system according to claim 16, wherein said valve assembly further comprises a bypass conduit leading from said fourth port to a point within said second chamber proximate to said second temperature sensitive actuator.

23. A cooling system according to claim 17, wherein said valve assembly further comprises a bypass conduit leading from said fourth port to a point within said second chamber proximate to said second temperature sensitive actuator.

24. A control valve assembly for a cooling system for an engine, comprising:

a valve casing formed with a first port, a second port, a third port, and a fourth port;

a first valve element and a first valve seat cooperating with said first valve element so as to open and close a first controlled aperture through said first valve seat, said first controlled aperture being on a first fluid flow path between said first port and said third port and being the only controlled aperture thereon, and also being on a third fluid flow path between said second port and said third port;

a second valve element and a second valve seat cooperating with said second valve element so as to open and close a second controlled aperture through said second valve seat, said second controlled aperture being on a second fluid flow path between said first port and said fourth port;

a third valve element and a third valve seat cooperating with said third valve element so as to open and close a third controlled aperture through said third valve seat, said third controlled aperture being on said third fluid flow path between said second port and said third port, said first and third controlled apertures being the only controlled apertures on said third fluid flow path between said second port and said third port;

a fourth valve element and a fourth valve seat cooperating with said fourth valve element so as to open and close a fourth controlled aperture through said fourth valve seat, said fourth controlled aperture being on a fourth fluid flow path between said second port and said fourth port and being the only controlled aperture thereon, and said fourth controlled aperture also being on said second fluid flow path between said first port and said fourth port, said second and fourth controlled apertures being the only controlled apertures on said second fluid flow path between said first port and said fourth port;

a first temperature sensitive actuator exposed to sense the temperature of the fluid conducted through said second port, which, when it senses a temperature less than a first predetermined temperature, moves said first valve element so as to press said first valve element against said first valve seat and so as to close said first controlled aperture through said first valve seat, interrupting communication between said first port and said third port via said first fluid flow path and between said second port and said third port via said third fluid flow path, and moves said second valve element so as to bring said second valve element away from said second valve seat and so as to open said second controlled aperture through said second valve seat, partially establishing communication between said first port and said fourth port via said second fluid flow path; and when it senses a temperature higher than said first predetermined temperature, moves said first valve element so as to bring said first valve element away from said first valve seat and so as to open said first controlled aperture through said first valve seat, establishing communication between said first port and said third port via said first fluid flow path and partially establishing communication between said second port and said third port via said third fluid flow path, and moves said second valve element so as to press said second valve element against said second valve seat and so as to close said second controlled aperture through said second valve seat, interrupting communication between said first port and said fourth port via said second fluid flow path;

a second temperature sensitve actuator exposed to sense the temperature of the fluid conducted through said second port, which, when it senses a temperature less than a second predetermined temperature which is higher than said first predetermined temperature, moves said third valve element so as to press said third valve element against said third valve seat and so as to close said third controlled aperture through said third valve seat, interrupting communication between said second port and said third port via said third flow path, and moves said fourth valve element so as to bring said fourth valve element away from said fourth valve seat and so as to open said fourth controlled aperture through said fourth valve seat, establishing communication between said second port and said fourth port via said fourth fluid flow path and partially establishing communication between said first port and said fourth port via said second fluid flow path; and when it senses a temperature higher than said second predetermined temperature, moves said third valve element so as to bring said third valve element away from said third valve seat and so as to open said third controlled aperture through said third valve seat, partially establishing communication between said second port and said third port via said third fluid flow path, and moves said fourth valve element so as to press said fourth valve element against said fourth valve seat and so as to close said fourth controlled aperture through said fourth valve seat, interrupting communication between said second port and said fourth port via said fourth fluid flow path and interrupting communication between said first port and said fourth port via said second fluid flow path.

25. A valve assembly according to claim 24, wherein said valve casing defines a first chamber and a second chamber, said first port opening into said first chamber, said second port opening into said second chamber, said first controlled aperture communicating said third port to said first chamber, and said fourth controlled aperture communicating said fourth port to said second chamber; said second controlled aperture and said third controlled aperture opening between said first chamber and said second chamber.

26. A valve assembly according to claim 25, wherein said first valve element and said first valve seat, said second valve element and said second valve seat, said third valve element and said third valve seat, and said fourth valve element and said fourth valve seat are all circular; said first valve element, said first valve seat, said second valve element, and said second valve seat all being coaxial with a common first axis, and said third valve element, said third valve seat, said fourth valve element, and said fourth valve seat also all being coaxial with a common second axis; said first valve element and said second valve element moving to and fro along said first axis by the action of said first temperature sensitive actuator so as to open and close said first controlled aperture and said second controlled aperture in cooperation with said first valve seat and said second valve seat, and said third valve element and said fourth valve element moving to and fro along said second axis by the action of said second temperature sensitive actuator so as to open and close said third controlled aperture and said fourth controlled aperture in cooperation with said third valve seat and said fourth valve seat.

27. A valve assembly according to claim 26, further comprising a valve shaft extending along said first axis to which said first valve element and said second valve element are fixed, said valve shaft being moved to and fro along said first axis by the action of said first temperature sensitive actuator so as to move said first valve element and said second valve element to and fro along said first axis and so as to open and to close said first controlled aperture and said second controlled aperture.

28. A valve assembly according to claim 26, further comprising a valve shaft extending along said first axis on which said first valve element and said second valve element are slidably mounted, said first valve element being biased relative to said valve shaft to a first preferred position thereon, and said second valve element being biased relative to said valve shaft to a second preferred position thereon, said valve shaft being moved to and fro along said first axis by the action of said first temperature sensitive actuator so as to move said first valve element and said second valve element to and fro along said first axis and so as to open and to close said first controlled aperture and said second controlled aperture.

29. A valve assembly according to claim 26, further comprising a first valve shaft extending along said first axis on which said first valve element is fixedly mounted and a second valve shaft extending along said first axis and axially opposing said first valve shaft on which said second valve element is slidably mounted, said first valve element and said first valve shaft being biased in the direction of said second valve shaft so as to impel said first valve element toward sair first valve seat, and said second valve element being biased relative to said second valve shaft to a preferred position thereon, said second valve shaft being moved to and fro along said first axis by the action of said first temperature sensitive actuator so as to move said second valve element to and fro along said first axis so as to open and to close said second controlled aperture, and so as to impinge axially on the assembly of said first valve shaft and said first valve element so as to impel said first valve element in the direction away from said first valve seat against said biasing which is overcome so as to open said first controlled aperture.

30. A valve assembly according to any one of claims 25–29, further comprising a bypass conduit leading from said fourth port to a point within said casing proximate to said second temperature sensitive actuator.

* * * * *